US006796362B2

(12) United States Patent
Lombard et al.

(10) Patent No.: US 6,796,362 B2
(45) Date of Patent: Sep. 28, 2004

(54) APPARATUS FOR PRODUCING A METALLIC SLURRY MATERIAL FOR USE IN SEMI-SOLID FORMING OF SHAPED PARTS

(75) Inventors: Patrick J. Lombard, Cedar Hill, MO (US); Shaupoh Wang, Chesterfield, MO (US); Walter L. Winterbottom, Jackson, TN (US); George Spiller, Rome, GA (US)

(73) Assignee: Brunswick Corporation, Lake Forest, IL (US)

( * ) Notice: Subject to any disclaimer, the term of this patent is extended or adjusted under 35 U.S.C. 154(b) by 47 days.

(21) Appl. No.: 10/234,008

(22) Filed: Sep. 3, 2002

(65) Prior Publication Data

US 2003/0102103 A1 Jun. 5, 2003

Related U.S. Application Data

(63) Continuation-in-part of application No. 09/584,859, filed on Jun. 1, 2000, now Pat. No. 6,443,216, and a continuation-in-part of application No. 10/160,726, filed on Jun. 3, 2002, which is a continuation of application No. 09/585,296, filed on Jun. 1, 2000, now Pat. No. 6,399,017.

(51) Int. Cl.[7] ..... B22D 41/05
(52) U.S. Cl. ..... 164/335; 164/338.1; 266/275
(58) Field of Search ..... 164/335, 338.1, 164/133; 266/275, 286

(56) References Cited

U.S. PATENT DOCUMENTS

| | | | |
|---|---|---|---|
| 972,429 | A | 10/1910 | Baird |
| 1,506,281 | A | 8/1924 | Baily |
| 1,776,355 | A | 9/1930 | Eppensteiner |
| 3,472,502 | A | 10/1969 | Schott |
| 3,791,015 | A | 2/1974 | Lucenti |

FOREIGN PATENT DOCUMENTS

| | | | |
|---|---|---|---|
| EP | 0701002 | A1 | 3/1996 |
| EP | 0710515 | A1 | 5/1996 |
| EP | 0745694 | A1 | 12/1996 |
| EP | 0841406 | A1 | 5/1998 |
| EP | 0903193 | A1 | 3/1999 |
| JP | 61-97555 | | 4/1986 |
| JP | 1-192446 | | 8/1989 |
| JP | 6-28939 | | 2/1994 |
| WO | WO 95/19237 | | 7/1995 |
| WO | WO 98/23403 | | 6/1998 |
| WO | WO 98/30346 | | 7/1998 |
| WO | WO 99/50007 | | 10/1999 |
| WO | WO 00/05015 | | 2/2000 |

OTHER PUBLICATIONS

U.S. patent application Ser. No. 09/250,824, Norville et al. "Semisolid Metal Process Eliminates Preformed Billets", by Samuel D. Norville, *Die Casting Management*, Mar. 1998, pp. 31–33.

(List continued on next page.)

*Primary Examiner*—M. Alexandra Elve
*Assistant Examiner*—Len Tran
(74) *Attorney, Agent, or Firm*—Woodard, Emhardt, Moriarty, McNett & Henry LLP

(57) ABSTRACT

An apparatus for producing a metallic slurry material for use in semi-solid forming of a shaped part. The apparatus is generally comprised of a forming vessel and a thermal jacket. The forming vessel defines an inner volume for containing the metallic slurry material and has an outer surface. The thermal jacket has an inner surface disposed in thermal communication with the outer surface of the forming vessel to effectuate heat transfer therebetween. At least one of the forming vessel and the thermal jacket defines a number of grooves to limit the rate of heat transfer adjacent the grooves. In one embodiment, the forming vessel defines a plurality of axially-offset grooves extending about the entire periphery of the outer surface of the forming vessel. In another embodiment, a stator is disposed about the thermal jacket to impart an electromagnetic stirring force to the metallic slurry material contained within the forming vessel.

43 Claims, 12 Drawing Sheets

U.S. PATENT DOCUMENTS 3,840,364 A 10/1974 Flemings et al.
3,842,895 A 10/1974 Mehrabian et al.
3,882,923 A 5/1975 Albemy et al.
3,902,544 A 9/1975 Flemings et al.
3,948,650 A 4/1976 Flemings et al.
3,951,651 A 4/1976 Mehrabian et al.
3,981,351 A 9/1976 Dompass
3,995,678 A 12/1976 Zavaras et al.
4,088,295 A 5/1978 Medovar et al.
4,089,680 A 5/1978 Flemings et al.
4,108,643 A 8/1978 Flemings et al.
4,125,364 A 11/1978 Stephens
4,174,214 A 11/1979 Bennett et al.
4,229,210 A 10/1980 Winter et al.
4,321,958 A 3/1982 Delassus
4,345,637 A 8/1982 Flemings et al.
4,415,374 A 11/1983 Young et al.
4,434,837 A 3/1984 Winter et al.
4,450,893 A 5/1984 Winter et al.
4,457,354 A 7/1984 Dantzig et al.
4,457,355 A 7/1984 Winter et al.
4,465,118 A 8/1984 Dantzig et al.
4,482,012 A 11/1984 Young et al.
4,494,461 A 1/1985 Pryor et al.
4,523,624 A 6/1985 Dantzig et al.
4,524,820 A 6/1985 Gullotti et al.
4,530,404 A 7/1985 Vives
4,555,272 A 11/1985 Ashok et al.
4,565,241 A 1/1986 Young
4,569,218 A 2/1986 Baker et al.
4,607,682 A 8/1986 Dantzig et al.
4,614,225 A 9/1986 Ernst et al.
RE32,529 E 10/1987 Vives
4,709,746 A 12/1987 Young et al.
4,712,413 A 12/1987 Koch
4,729,422 A 3/1988 Ernst et al.
4,774,992 A 10/1988 George
4,838,988 A 6/1989 Lang et al.
4,877,079 A 10/1989 Long et al.
5,098,487 A 3/1992 Brauer et al.
5,135,564 A 8/1992 Fujikawa et al.
5,219,018 A 6/1993 Meyer
5,247,988 A 9/1993 Kurzinski
5,332,200 A 7/1994 Gorin et al.
5,416,795 A 5/1995 Kaniuk et al.
5,425,048 A 6/1995 Heine et al.
5,501,266 A 3/1996 Wang et al.
5,529,391 A 6/1996 Kindman et al.
5,539,183 A * 7/1996 Beckley ..... 219/386
5,549,732 A 8/1996 Dube et al.
5,585,067 A 12/1996 Leroy et al.
5,630,466 A 5/1997 Garat et al.
5,701,942 A 12/1997 Adachi et al.
5,781,581 A 7/1998 Fishman et al.
5,887,640 A 3/1999 Brown et al.
5,899,567 A 5/1999 Morris, Jr.
5,900,080 A 5/1999 Baldi et al.
5,925,199 A 7/1999 Shiina et al.
6,003,590 A 12/1999 Pavlicevic et al.
6,021,842 A 2/2000 Bulhoff et al.
6,065,526 A 5/2000 Kono
6,165,411 A 12/2000 Adachi
6,196,294 B1 * 3/2001 Ohnsmann et al. ..... 164/119
6,258,315 B1 * 7/2001 Araki et al. ..... 266/193

* cited by examiner

APPARATUS FOR PRODUCING A METALLIC SLURRY MATERIAL FOR USE IN SEMI-SOLID FORMING OF SHAPED PARTS

CROSS REFERENCE TO RELATED APPLICATIONS

This application is a continuation-in-part of U.S. patent application Ser. No. 09/584,859 filed on Jun. 1, 2000, now U.S. Pat. No. 6,443,216 and of U.S. patent application Ser. No. 10/160,726 filed on Jun. 3, 2002, which is a continuation of U.S. patent application Ser. No. 09/585,296 filed on Jun. 1, 2000, now issued as U.S. Pat. No. 6,399,017. The contents of each of the above-listed applications are expressly incorporated herein by reference.

BACKGROUND OF THE INVENTION

The present invention relates in general to an apparatus constructed and arranged for producing an "on-demand" semi-solid material for use in a casting process. Included as part of the overall apparatus are various stations which have the requisite components and structural arrangements which are to be used as part of the process. The method of producing the on-demand semi-solid material, using the disclosed apparatus, is included as part of the present invention.

More particularly, one embodiment of the present invention relates to a thermal jacket for engaging the exterior of a forming vessel containing molten metal to control the heating/cooling rate of the molten metal during the semi-solid material forming process. Although the present invention was developed for use in the semi-solid forming of metals or metal alloys, certain applications of the invention may fall outside of this field.

The present invention incorporates electromagnetic stirring and various temperature control and cooling control techniques and apparata to facilitate the production of the semi-solid material within a comparatively short cycle time. Also included are structural arrangements and techniques to discharge the semi-solid material directly into a casting machine shot sleeve. As used herein, the concept of "on-demand" means that the semisolid material goes directly to the casting step from the vessel where the material is produced. The semi-solid material is typically referred to as a "slurry" and the slug which is produced as a "single shot" is also referred to as a billet. These terms have been combined in this disclosure to represent a volume of slurry which corresponds to the desired single shot billet.

Semi-solid forming of light metals for net-shape and near-net shape manufacturing can produce high strength, low porosity components with the economic cost advantages of die-casting. However, the semi-solid molding (SSM) process is a capital-intensive proposition tied to the use of metal purchased as pre-processed billets or slugs.

Parts made with the SSM process are known for high quality and strength. SSM parts compare favorably with those made by squeeze casting, a variation of die-casting that uses large gate areas and a slow cavity fill. Porosity is prevented by slow, non-turbulent metal velocities (gate velocities between 30 and 100 in./sec.) and by applying extreme pressure to the part during solidification. Both squeeze casting and SSM processes produce uniformly dense parts that are heat-treatable.

SSM offers the process economics of die casting and the mechanical properties that approach those of forgings. In addition, SSM capitalizes on the non-dendritic microstructure of the metal to produce parts of high quality and strength. SSM can cast thinner walls than squeeze casting due to the globular alpha grain structure, and it has been used successfully with both aluminum and magnesium alloys. SSM parts are weldable and pressure tight without the need for impregnation under extreme pressure that characterizes the squeeze-cast process.

The SSM process has been shown to hold tighter dimensional capabilities than any other aluminum molding process. That has intensified demand for SSM components due to the potential for significant cost savings, reduction of machining, and quicker cycle times for higher production rates. Besides high strength and minimal porosity, SSM parts exhibit less part-to-die shrinkage than die cast parts and very little warpage. It produces castings that are closer to the desired net shape, which reduces and can even eliminate secondary machining operations. Surface finishes on the castings are often better than the iron and steel parts they replace.

The SSM process requires higher final mold pressure (15,000 to 30,000 psi) than conventional die casting (7,000 to 12,000 psi), but modern die casting equipment provides the flexibility needed to produce SSM parts efficiently and economically. Real-time, closed-loop hydraulic circuits incorporated into today's die casting machines can automatically maintain the correct fill velocities of the SSM material alloy. Closed-loop process control systems monitor metal temperature and time, voltage feedback from electrical stator and other data to provide a very robust and precisely controlled operation that can maximize productivity of high quality parts and ensure reproducibility.

As described, it is well known that semi-solid metal slurry can be used to produce products with high strength and low porosity at net shape or near net shape. However, the viscosity of semi-solid metal is very sensitive to the slurry's temperature or the corresponding solid fraction. In order to obtain good fluidity at high solid fraction, the primary solid phase of the semi-solid metal should be nearly spherical.

In general, semi-solid processing can be divided into two categories; thixocasting and rheocasting. In thixocasting, the microstructure of the solidifying alloy is modified from dendritic to discrete degenerated dendrite before the alloy is cast into solid feedstock, which will then be re-melted to a semi-solid state and cast into a mold to make the desired part. In rheocasting, liquid metal is cooled to a semi-solid state while its microstructure is modified. The slurry is then formed or cast into a mold to produce the desired part or parts.

The major barrier in rheocasting is the difficulty to generate sufficient slurry within preferred temperature range in a short cycle time. Although the cost of thixocasting is higher due to the additional casting and remelting steps, the implementation of thixocasting in industrial production has far exceeded rheocasting because semi-solid feedstock can be cast in large quantities in separate operations which can be remote in time and space from the reheating and forming steps.

In a semi-solid casting process, generally, a slurry is formed during solidification consisting of dendritic solid particles whose form is preserved. Initially, dendritic particles nucleate and grow as equiaxed dendrites within the molten alloy in the early stages of slurry or semi-solid formation. With the appropriate cooling rate and stirring, the dendritic particle branches grow larger and the dendrite arms have time to coarsen so that the primary and secondary dendrite arm spacing increases. During this growth stage in the presence of stirring, the dendrite arms come into contact and become fragmented to form degenerate dendritic particles. At the holding temperature, the particles continue to coarsen and become more rounded and approach an ideal spherical shape. The extent of rounding is controlled by the holding time selected for the process. With stirring, the point of "coherency" (the dendrites become a tangled structure) is not reached. The semi-solid material comprised of fragmented, degenerate dendrite particles continues to deform at low shear forces. The present invention incorporates apparata and methods in a novel and unobvious manner which utilize the metallurgical behavior of the alloy to create a suitable slurry within a comparatively short cycle time.

When the desired fraction solid and particle size and shape have been attained, the semi-solid material is ready to be formed by injecting into a die-mold or some other forming process. Silicon particle size is controlled in the process by limiting the slurry creation process to temperatures above the point at which solid silicon begins to form and silicon coarsening begins.

It is known that the dendritic structure of the primary solid of a semi-solid alloy can be modified to become nearly spherical by introducing the following perturbation in the liquid alloy near liquidus temperature or semi-solid alloy:

1) Stirring: mechanical stirring or electromagnetic stirring;
2) Agitation: low frequency vibration, high-frequency wave, electric shock, or electromagnetic wave;
3) Equiaxed Nucleation: rapid under-cooling, grain refiner;
4) Oswald Ripening and Coarsening: holding alloy in semi-solid temperature for a long time.

While the methods in (2)–(4) have been proven effective in modifying the microstructure of semi-solid alloy, they have the common limitation of not being efficient in the processing of a high volume of alloy with a short preparation time due to the following characteristics or requirements of semi-solid metals:

High dampening effect in vibration.

Small penetration depth for electromagnetic waves.

High latent heat against rapid under-cooling.

Additional cost and recycling problem to add grain refiners.

Natural ripening takes a long time, precluding a short cycle time.

While most of the prior art developments have been focused on the microstructure and rheology of semi-solid alloy, temperature control has been found by the present inventors to be one of the most critical parameters for reliable and efficient semi-solid processing with a comparatively short cycle time. As the apparent viscosity of semi-solid metal increases exponentially with the solid fraction, a small temperature difference in the alloy with 40% or higher solid fraction results in significant changes in its fluidity. In fact, the greatest barrier in using methods (2)–(4), as listed above, to produce semi-solid metal is the lack of stirring. Without stirring, it is very difficult to make alloy slurry with the required uniform temperature and microstructure, especially when the there is a requirement for a high volume of the alloy. Without stirring, the only way to heat/cool semi-solid metal without creating a large temperature difference is to use a slow heating/cooling process. Such a process often requires that multiple billets of feedstock be processed simultaneously under a pre-programmed furnace and conveyor system, which is expensive, hard to maintain, and difficult to control.

While using high-speed mechanical stirring within an annular thin gap can generate high shear rate sufficient to break up the dendrites in a semi-solid metal mixture, the thin gap becomes a limit to the process's volumetric throughput. The combination of high temperature, high corrosion (e.g. of molten aluminum alloy) and high wearing of semi-solid slurry also makes it very difficult to design, to select the proper materials and to maintain the stirring mechanism.

Prior references disclose the process of forming a semi-solid slurry by reheating a solid billet, formed by thixocasting, or directly from the melt using mechanical or electromagnetic stirring. The known methods for producing semi-solid alloy slurries include mechanical stirring and inductive electromagnetic stirring. The processes for forming a slurry with the desired structure are controlled, in part, by the interactive influences of the shear and solidification rates.

In the early 1980's, an electromagnetic stirring process was developed to cast semisolid feedstock with discrete degenerate dendrites. The feedstock is cut to proper size and then remelt to semi-solid state before being injected into mold cavity. Although this magneto hydrodynamic (MHD) casting process is capable of generating high volume of semi-solid feedstock with adequate discrete degenerate dendrites, the material handling cost to cast a billet and to remelt it back to a semi-solid composition reduces the competitiveness of this semi-solid process compared to other casting processes, e.g. gravity casting, low-pressure die-casting or high-pressure die-casting. Most of all, the complexity of billet heating equipment, the slow billet heating process and the difficulties in billet temperature control have been the major technical barriers in semi-solid forming of this type.

The billet reheating process provides a slurry or semi-solid material for the production of semi-solid formed (SSF) products. While this process has been used extensively, there is a limited range of castable alloys. Further, a high fraction of solids (0.7 to 0.8) is required to provide for the mechanical strength required in processing with this form of feedstock. Cost has been another major limitation of this approach due to the required processes of billet casting, handling, and reheating as compared to the direct application of a molten metal feedstock in the competitive die and squeeze casting processes.

In the mechanical stirring process to form a slurry or semi-solid material, the attack on the rotor by reactive metals results in corrosion products that contaminate the solidifying metal. Furthermore, the annulus formed between the outer edge of the rotor blades and the inner vessel wall within the mixing vessel results in a low shear zone while shear band formation may occur in the transition zone between the high and low shear rate zones. There have been a number of electromagnetic stirring methods described and used in preparing slurry for thixocasting billets for the SSF process, but little mention has been made of an application for rheocasting.

The rheocasting, i.e., the production by stirring of a liquid metal to form semi-solid slurry that would immediately be shaped, has not been industrialized so far. It is clear that rheocasting should overcome most of limitations of thixocasting. However, in order to become an industrial production technology, i.e., producing stable, deliverable semi-solid slurry on-line (i.e., on-demand) rheocasting must overcome the following practical challenges: cooling rate control, microstructure control, uniformity of temperature and microstructure, the large volume and size of slurry, short cycle time control and the handling of different types of alloys, as well as the means and method of transferring the slurry to a vessel and directly from the vessel to the casting shot sleeve.

One of the ways to overcome above challenges, according to the present invention, is to apply electromagnetic stirring of the liquid metal when it is solidified into semi-solid ranges. Such stirring enhances the heat transfer between the liquid metal and its container to control the metal temperature and cooling rate, and generates the high shear rate inside of the liquid metal to modify the microstructure with discrete degenerate dendrites. It increases the uniformity of metal temperature and microstructure by means of the molten metal mixture. With a careful design of the stirring mechanism and method, the stirring drives and controls a large volume and size of semi-solid slurry, depending on the application requirements. The stirring helps to shorten the cycle time by controlling the cooling rate, and this is applicable to all type of alloys, i.e., casting alloys, wrought alloys, MMC, etc.

While propeller type mechanical stirring has been used in the context of making a semi-solid slurry, there are certain problems or limitations. For example, the high temperature and the corrosive and high wearing characteristics of semi-solid slurry, makes it very difficult to design a reliable slurry apparatus with mechanical stirring. However, the most critical limitation of using mechanical stirring in rheocasting is that its small throughput cannot meet the requirements production capacity. It is also known that semisolid metal with discrete degenerated dendrite can also be made by introducing low frequency mechanical vibration, high-frequency ultra-sonic waves, or electric-magnetic agitation with a solenoid coil. While these processes may work for smaller samples at slower cycle time, they are not effective in making larger billet because of the limitation in penetration depth. Another type of process is solenoidal induction agitation, because of its limited magnetic field penetration depth and unnecessary heat generation, it has many technological problems to implement for productivity. Vigorous electromagnetic stirring is the most widely used industrial process permits the production of a large volume of slurry. Importantly, this is applicable to any high-temperature alloys.

Two main variants of vigorous electromagnetic stirring exist, one is rotational stator stirring, and the other is linear stator stirring. With rotational stator stirring, the molten metal is moving in a quasi-isothermal plane, therefore, the degeneration of dendrites is achieved by dominant mechanical shear. U.S. Pat. No. 4,434,837, issued Mar. 6, 1984 to Winter et al., describes an electromagnetic stirring apparatus for the continuous making of thixotropic metal slurries in which a stator having a single two pole arrangement generates a non-zero rotating magnetic field which moves transversely of a longitudinal axis. The moving magnetic field provides a magnetic stirring force directed tangentially to the metal container, which produces a shear rate of at least 50 $sec^{-1}$ to break down the dendrites. With linear stator stirring, the slurries within the mesh zone are recirculated to the higher temperature zone and remelted, therefore, the thermal processes play a more important role in breaking down the dendrites. U.S. Pat. No. 5,219,018, issued Jun. 15, 1993 to Meyer, describes a method of producing thixotropic metallic products by continuous casting with polyphase current electromagnetic agitation. This method achieves the conversion of the dendrites into nodules by causing a refusion of the surface of these dendrites by a continuous transfer of the cold zone where they form towards a hotter zone.

A part formed according to this invention will typically have equivalent or superior mechanical properties, particularly elongation, as compared to castings formed by a fully liquid-to-solid transformation within the mold, the latter castings having a dendritic structure characteristic of other casting processes.

The embodiments of the present invention disclosed herein are directed to an apparatus for producing a metallic slurry material for application in semi-solid forming of shaped parts. In the art of casting, molten metal is transferred to a forming vessel or crucible where it is completely or at least partially solidified. A heating/cooling system is sometimes provided to impart or extract thermal energy during complete or partial solidification of the molten metal. The heating/cooling system serves to control the solidification rate by regulating the temperature of the molten metal, thereby allowing the molten metal to cool at a controlled rate until the desired temperature and material solidity are reached.

Considerations in the design of a suitable heating/cooling system include its capacity to uniformly add and/or remove heat from the metal, as well as its ability to accurately control the temperature of the metal throughout the solidification process. The system should also have sufficient thermal capacity to dissipate heat quickly and efficiently to the environment to shorten cycle times and increase volumetric output. Additionally, the removal or addition of heat should be as uniform as possible to provide a solidified or partially solidified metal having a homogenous and uniform viscosity and microstructure.

Heretofore, there has been a need for an improved apparatus for producing a metallic slurry material for use in semi-solid forming of shaped parts. The present invention satisfies this need in a novel and unobvious way.

SUMMARY OF THE INVENTION

One form of the present invention contemplates an apparatus for producing a metallic slurry material for use in semi-solid forming, comprising a vessel for containing the metallic slurry material and having an outer surface, and a thermal jacket disposed in thermal communication with the vessel to effectuate heat transfer therebetween. At least one of the vessel and the thermal jacket defines at least one groove to limit heat transfer adjacent thereto.

Another form of the present invention contemplates an apparatus for producing a metallic slurry material for use in semi-solid forming, comprising a vessel defining an inner volume for containing the metallic slurry material and having an outer surface, and a thermal jacket having an inner surface disposed in thermal communication with the outer surface of the vessel to effectuate heat transfer therebetween. First portions of the inner and outer surfaces are disposed in immediate proximity to one another to facilitate heat transfer, and second portions of the inner and outer surfaces are spaced from one another to limit heat transfer.

Another form of the present invention contemplates an apparatus for producing a metallic slurry material for use in semi-solid forming, comprising a vessel defining an inner volume for containing the metallic slurry material, and a thermal jacket defining an inner passage sized and shaped to removably receive at least a portion of the vessel therein. At least one of the vessel and the thermal jacket defines at least one groove. The vessel is removably disposed within the inner passage of the thermal jacket to position the vessel in thermal communication therewith to effectuate heat transfer therebetween, with the heat transfer being limited adjacent the at least one groove.

Another form of the present invention contemplates an apparatus for producing a metallic slurry material for use in semi-solid forming, comprising a temperature-controlled vessel including an inner portion defining an inner volume for containing the metallic slurry material and an outer portion disposed about at least a portion of the inner portion. The inner portion of the vessel has an outer surface disposed in thermal communication with an inner surface of the outer portion to effectuate heat transfer therebetween, with at least one of the inner and outer surfaces defines at least one groove to limit heat transfer adjacent thereto.

One object of the present invention is to provide an improved apparatus for producing a metallic slurry material for use in semi-solid forming of shaped parts.

Further forms, embodiments, objects, features, advantages, benefits, and aspects of the present invention shall become apparent from the drawings and descriptions provided herein.

DESCRIPTION OF THE PREFERRED EMBODIMENTS

Figure 1:
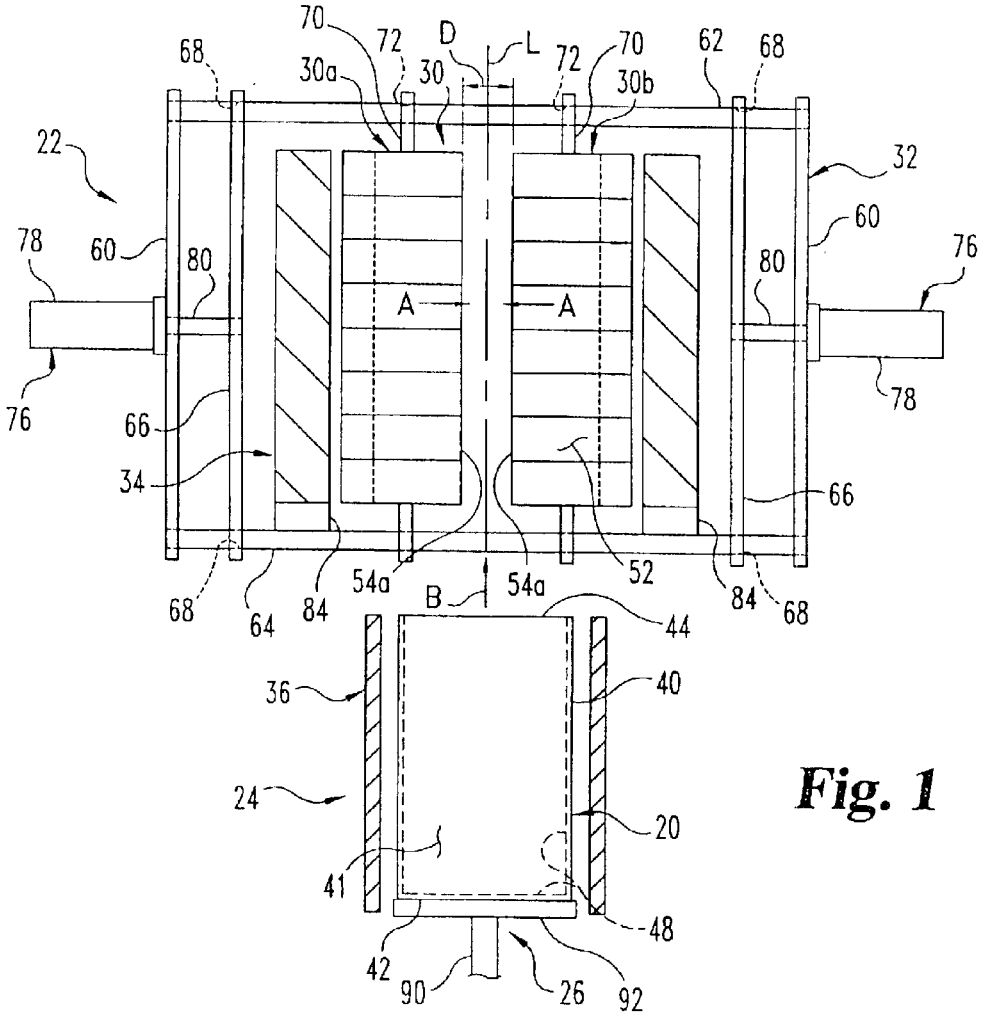
FIG. 1 is a side elevational view, in partial section, of an apparatus according to one form of the present invention for use in producing a metallic slurry material for in semi-solid forming of shaped parts.

For the purposes of promoting an understanding of the principals of the invention, reference will now be made to the embodiment illustrated in the drawings and specific language will be used to describe the same. It will nevertheless be understood that no limitation of the scope of the invention is hereby intended, and any alterations and further modifications of the illustrated device, and any further applications of the principals of the invention as illustrated herein being contemplated as would normally occur to one skilled in the art to which the invention relates.

The present invention provides an apparatus for and method of producing semisolid slurry, on demand, having a particular fraction solid and a particular solid-particle morphology. A brief description of the apparatus and method is provided below; however, further details are disclosed in the co-pending U.S. patent application Ser. No. 09/585,061 filed on Jun. 1, 2000, the contents of which are hereby expressly incorporated by reference.

Figure 2:
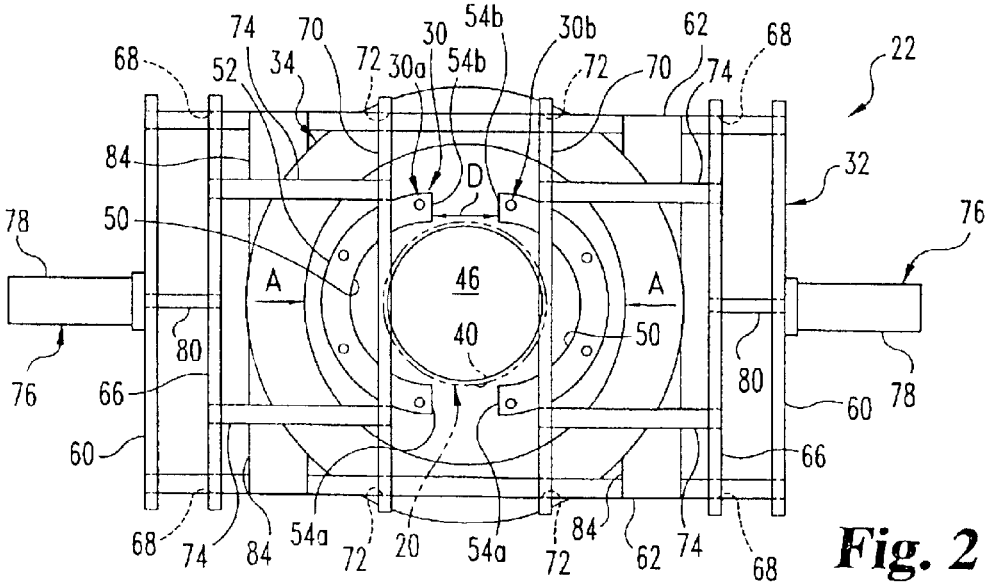
FIG. 2 is a top plan view of the apparatus depicted in FIG. 1.

With reference to FIGS. 1 and 2, there is illustrated an apparatus for producing a semi-solid slurry billet of a metal or metal alloy for subsequent use in various casting or forging applications. The apparatus generally comprises a vessel or crucible 20 for containing the molten metal, a forming station 22, a discharge station 24, and a transport mechanism 26 for transporting the vessel 20 between the forming and discharge stations 22, 24. The forming station 22 generally includes a thermal jacket 30 for controlling the temperature and cooling rate of the metal or alloy contained within vessel 20, a framework 32 for supporting and engaging thermal jacket 30 about vessel 20, and an electromagnetic stator 34 for electromagnetically stirring the metal contained within vessel 20. The discharge station 24 generally includes an induction coil 36 for facilitating the removal of the slurry billet from vessel 20 by breaking the surface bond therebetween, and means for discharging the slurry billet from vessel 20 (not shown) for subsequent transport directly to the shot sleeve of a casting or forging press.

The vessel 20 is preferably made of a non-magnetic material having low thermal resistance, good electromagnetic penetration capabilities, good corrosion resistance, and relatively high strength at high temperatures. Because vessel 20 must absorb heat from the metal contained therein and dissipate it quickly to the surrounding environment, low thermal resistance is an important factor in the selection of a suitable vessel material. Additionally, material density and thickness must also be given consideration. By way of example, vessel 20 may be made of materials including, but not limited to, graphite, ceramics, and stainless steel. To provide additional resistance to attack by reactive alloys, such as molten aluminum, and to aid in discharging the slurry billet after the forming process is completed, the inside surface of vessel 20 is preferably coated or thermally sprayed with boron nitride, a ceramic coating, or any other suitable material.

The vessel 20 preferably has a can shape, including a sidewall 40 defining a cylindrical exterior surface 41, a flat bottom wall 42, and an open top 44. Sidewall 40 and bottom wall 42 cooperate to define a hollow interior 46 bounded by interior surfaces 48. In one embodiment, vessel 20 has an outer diameter in a range of about two inches to eight inches, an overall height in a range of about nine inches to about eighteen inches, and a wall thickness in a range of about 0.05 inches to about 2 inches. However, it should be understood that other shapes and sizes of vessel 20 are also contemplated. For example, vessel 20 could alternatively define shapes such as a square, polygon, ellipse, or any other shape as would occur to one of ordinary skill in the art. Additionally, the size of vessel 20 could be changed to vary the ratio between volume and exposed interior/exterior surface area. For example, doubling the diameter of vessel 20 would correspondingly double the exposed surface area of sidewall 40, but would quadruple the volume of interior 46. Factors which may affect the selection of a suitable ratio include the desired volumetric capacity and cooling capability of vessel 20.

Although vessel 20 has been illustrated and described as having a substantially rigid, one-piece configuration, it should be understood that other configurations are also contemplated. For example, vessel 20 could be split lengthwise into two separate halves, with the halves being pivotally connected by a hinge to define a clam-shell type configuration. Additionally, vessel 20 could include heating and/or cooling elements to aid in controlling the temperature and cooling rate of the metal or alloy contained within vessel 20, particularly during the solidification process. More specifically, the vessel walls could be configured with internal heating/cooling lines to control the temperature and cooling rate of the vessel. Heat sinks or fins could also be provided on sidewall 40 to facilitate a higher conductive and/or convective heat transfer rate between vessel 20 and the surrounding environment. Other alternative configurations and additional design details regarding the type of vessel which is suitable for use as part of the present invention are disclosed in U.S. patent application Ser. No. 09/585,296, now U.S. Pat. No. 6,399,017.

Thermal jacket 30 is preferably made of a non-magnetic material having high thermal conductivity, good electromagnetic penetration capabilities, and relatively high strength. Because the primary purpose of thermal jacket 30 is to facilitate heat transfer between vessel 20 and a heating and/or cooling media, thermal conductivity is a particularly important factor in the selection of a suitable thermal jacket material. Additionally, because the heating/cooling capability of thermal jacket 30 is influenced by material density, specific heat and thickness, consideration must be given to these factors as well. More specifically, the amount of energy to be added/extracted ($\Delta E$) by thermal jacket 30 from the metal contained within vessel 20 is dictated by the following equation: $\Delta E=(\rho)(C_p)(V)(\Delta T)$, where $\rho$ is material density, $C_p$ is material specific heat, V is material volume, and $\Delta T$ is temperature change of the material per cycle. Further, the material of thermal jacket 30 should preferably have a coefficient of thermal expansion which is near that of vessel 20, the importance of which will become apparent below. Moreover, the material should preferably be easily machinable, the importance of which will also become apparent below. By way of example, thermal jacket 30 may be made of materials including, but not limited to, bronze, copper or aluminum.

Thermal jacket 30 extends along a longitudinal axis L and includes two generally symmetrical longitudinal halves 30*a*, 30*b*. Each half 30*a*, 30*b* has a substantially semi-cylindrical shape, defining a rounded inner surface 50, a rounded outer surface 52, and a pair of generally flat longitudinal edges 54*a*, 54*b*. The inner surface 50 is substantially complementary to the exterior surface 41 of vessel 20. In one embodiment, each half 30*a*, 30*b* of thermal jacket 30 has an inner radius approximately equal to or slightly greater than the outer radius of vessel 20, an overall height approximately equal to or greater than the height of vessel 20, and a wall thickness of about 1 inch. However, it should be understood that other shapes and sizes of thermal jacket 30 are also contemplated as would occur to one of ordinary skill in the art, including shapes and sizes complementary to those listed above with regard to vessel 20. Additionally, although thermal jacket 30 has been illustrated and described as having separate longitudinal portions 30*a*, 30*b*, it should be understood that other configurations are also possible. For example, thermal jacket 30 could alternatively take on a solid cylindrical configuration, or halves 30*a*, 30*b* could be hinged together to define a clam-shell type configuration. Further, thermal jacket 30 could alternatively include non-symmetrical longitudinal portions.

As will be discussed in greater detail below, thermal jacket 30 is provided with means for controlling the rate of heat transfer from vessel 20 to the surrounding environment through the addition/removal of heat to/from vessel 20. In one embodiment, thermal jacket 30 has the capacity to control the cooling rate of the metal contained in vessel 20 within a range of about 0.1° Celsius to about 10° Celsius per second. However, it should be understood that other cooling rates may also be utilized depending on the particular composition of metal being formed and the desired result to be obtained.

Framework 32 is provided to support thermal jacket 30 and stator 34, and to laterally displace thermal jacket halves 30*a*, 30*b* relative to longitudinal axis L. Framework 32 includes a pair of stationary base plates 60, interconnected by a pair of upper transverse guide rods 62 and a pair of lower transverse guide rods 64 to form a substantially rigid base structure. Upper and lower guide rods 62, 64 are each aligned substantially parallel to one another and oriented substantially perpendicular to longitudinal axis L. Although upper and lower guide rods 62, 64 have been illustrated and described as having a circular cross section, it should be understood that other cross sectional shapes are also contemplated, such as, for example, a square or rectangular cross section.

Framework 32 additionally includes a pair of movable actuator plates 66, each defining four openings 68 sized to receive respective ones of the upper and lower guide rods 62, 64 therethrough to allow actuator plates 66 to slide along upper and lower guide rods 62, 64 in a direction normal to longitudinal axis L. A movable connector plate 70 is rigidly attached to an upper surface of each thermal jacket half 30*a*, 30*b*, defining a pair of openings 72 sized to receive respective ones of the upper guide rods 62 therethrough to allow connector plate 70 to slide along upper guide rods 62 in a direction substantially normal to longitudinal axis L. Each connector plate 70 is interconnected to a corresponding actuator plate 66 by a pair of push rods 74 (FIG. 2). Alternatively, each connector plate 70 may be interconnected to a corresponding actuator plate 66 by a pair of plates or any other suitable connecting structure. A pair of pneumatic cylinders 76 are provided, each having a base portion 78 attached to base plate 60 and a rod portion 80 extending through base plate 60 and connected to actuator plate 66. By extending pneumatic cylinders 76, the thermal jacket halves 30*a*, 30*b* are displaced toward one another in the direction of arrows A. By retracting pneumatic cylinders 76, the thermal jacket halves 30*a*, 30*b* are displaced away from another in a direction opposite arrows A.

Although framework 32 and pneumatic cylinders 76 have been illustrated and described as providing means for selectively engaging/disengaging the thermal jacket halves 30*a*, 30*b* against the exterior surface 41 of vessel 20, it should be understood that alternative means are also contemplated, such as by way of a robotic arm or a similar actuating device. It should also be understood that the thermal jacket 30 could alternatively be securely attached directly to the exterior surface 41 of vessel 20, such as by a welding or fastening, thereby eliminating the need for framework 32 and pneumatic cylinders 76.

Electromagnetic stator 34 has a cylindrical shape and is positioned along longitudinal axis L, generally concentric with vessel 20. Stator 34 is preferably supported by framework 32, resting on a pair of cross members 84 extending between lower guide rods 64. The inner diameter of stator 34 is sized such that when the thermal jacket halves 30*a*, 30*b* are in their fully retracted positions, outer surfaces 52 will not contact the inner surfaces of stator 34. Stator 34 is preferably a multiple pole, multiple phase stator and can be of a rotary type, a linear type, or a combination of both. The magnetic field created by stator 34 preferably moves about vessel 20 in directions either substantially normal or substantially parallel to longitudinal axis L, or a combination of both. It is noted that even in applications using only a rotary type stator, where the magnetic field moves in a directions substantially normal to the longitudinal axis L, in addition to rotational movement of the metallic melt contained within vessel 20, longitudinal movement of the metallic melt is also possible.

The operation of stator 34 imparts a vigorous stirring action to the metallic melt contained within vessel 20 without actually coming into direct contact therewith. Additional design details regarding the types of stators which are suitable for the present invention, the arrangement of these stators, whether rotary, linear, or both, and the flow movement patterns corresponding to each stator arrangement are disclosed in U.S. patent application Ser. No. 09/585,296, now U.S. Pat. No. 6,402,367, the contents of which are expressly incorporated by reference.

In summary, the apparatus described above operates in the following manner. Initially, the thermal jacket halves 30*a*, 30*b* are placed in their fully retracted position by retracting pneumatic cylinders 76. Vessel 20, which at this point is empty, is raised in the direction of arrow B along longitudinal axis L from discharge station 24 to forming station 22 by way of the transport mechanism 26. In one embodiment, transport mechanism 26 includes a pneumatic cylinder (not shown) having a rod portion 90 connected to a flat circular platform 92. However, it should be understood that other means for transporting vessel 20 are also contemplated as would occur to those of ordinary skill in the art, such as, for example, a robotic arm or a similar actuating device. Vessel 20 rests on platform 92 and is preferably securely attached thereto by any means know to those of skill in the art, such as, for example, by fastening or welding. Once vessel 20 is positioned between the thermal jacket halves 30*a*, 30*b* (as shown in phantom in FIG. 2), the pneumatic cylinders. 76 are extended, thereby engaging the inner surfaces 50 of the thermal jacket halves 30*a*, 30*b* into intimate contact with the exterior surface 41 of vessel 20.

Liquid metal, also referred to as a metallic melt, is then introduced into vessel 20 through upper opening 44. The liquid metal is prepared with the proper composition and heated in a furnace to a temperature higher than its liquidus temperature (the temperature at which a completely molten alloy first begins to solidify). Preferably, the liquid metal is heated to a temperature at least 5° Celsius above the liquidus temperature, and is more preferably heated to a temperature within a range of about 15° Celsius to about 70° Celsius above the liquidus temperature to avoid or at least reduce the possibility of premature solidification or skinning of the liquid metal. In one embodiment, the liquid metal is transferred to vessel 20 by a ladle (not shown); however, other suitable means are also contemplated, such as by conduit.

To avoid formation of a solidified skin, possibly resulting from contact of the liquid metal with the cool interior surfaces of vessel 20, the vessel walls 40, 42 are preferably pre-heated prior to the introduction of liquid metal. Such warming may be effected by way of thermal jacket 30 (as will be discussed below), by heating elements internal to vessel 20 (as discussed above), through the heating of vessel 20 during prior cycling of the system, or by any other suitable means occurring to those of skill in the art, such as by forced air heating. Preferably, when the alloy is Al357 or a similar composition, vessel 20 should be at a temperature of at least 200–500° Celsius prior to the introduction of liquid metal to avoid skinning or premature solidification.

Following the introduction of the molten melt into vessel 20, a cap or lid (not shown) is preferably lowered onto the open top of vessel 20 to prevent molten metal from escaping during the electromagnetic stirring process. The cap may be made from ceramic, stainless steel or any other suitable material. An electromagnetic field is then introduced by stator 34 to impart vigorous stirring action to the metallic melt. Preferably, the stirring operation commences immediately after the cap is positioned atop vessel 20. The metal is then cooled at a controlled rate and temperature throughout the stirring process by way of thermal jacket 30, the operation of which will be discussed in greater detail below. The removal of heat by thermal jacket 30 causes the liquid metal to begin to solidify, thereby forming a semi-solid slurry material.

Thermal jacket 30 provides continuous control over the temperature and cooling rate of the semi-solid slurry throughout the stirring process in order to achieve the desired slurry temperature as quickly as possible, within reason, and taking into consideration metallurgical realities, in order to achieve a comparatively short cycle time. While the primary purpose of the electromagnetic stirring is to effect nucleation and growth of the primary phase with degenerated dendritic structure, with the fraction solid, primary particle size and shape, and the delivery temperature being dictated by holding time and temperature, another purpose of the stirring process is to enhance the convective heat transfer rate between the liquid metal and the interior surfaces 48 of vessel 20. A further purpose of the stirring process is to reduce temperature gradients within the metal, thereby providing increased control over the metal temperature and the cooling rate. Still another purpose of the stirring process is to avoid, or at least minimize, the possibility of the metal in direct contact with the interior surfaces 48 of vessel 20 from forming a skin.

Upon completion of the electromagnetic stirring step, the thermal jacket halves 30*a*, 30*b* are once again placed in their fully retracted position by retracting pneumatic cylinders 76. Vessel 20, which now contains a metallic melt in the form of a slurry billet, is lowered in a direction opposite arrow B along longitudinal axis L until positioned within the induction coil 36 (FIG. 1). The induction coil 36 is then activated to generate a magnetic field which melts the outer skin of the slurry billet, breaking the surface bond existing between the interior surface of vessel 20 and the billet. Additionally, the magnetic field generated by the induction coil 36 exerts a radial compressive force onto the slurry billet to further facilitate its removal from vessel 20. In one embodiment, AC current is discharged through the induction coil 36 surrounding the vessel 20 to generate the magnetic field; however, strong magnetic forces can also be generated by discharging a high-voltage DC current through induction coil 36 disposed adjacent the bottom wall 42 of vessel 20.

After the surface bond between the slurry billet and the vessel 20 is broken, the billet is then discharged from vessel 20 and transferred directly to the shot sleeve of a casting or forging press where it is formed into its final shape or configuration. One method of discharging the slurry billet is to tilt vessel 20, along with induction coil 36, at an appropriate angle below horizontal to allow the billet to slide from vessel 20 by gravity. Such tilting action can be accomplished by a tilt table arrangement, a robotic arm, or any other means for tilting as would be apparent to those of skill in the art. Additionally, if the centers of induction coil 36 and vessel 20 are axially offset, activation of induction coil 36 will exert an axial pushing force onto the billet to further facilitate its discharge. Additional details regarding a type of induction coil which is suitable for use as part of the present invention, as well as alternative slurry billet discharge methods and apparata, are disclosed in U.S. patent application Ser. No. 09/585,296, now U.S. Pat. No. 6,399,017.

Figure 3:
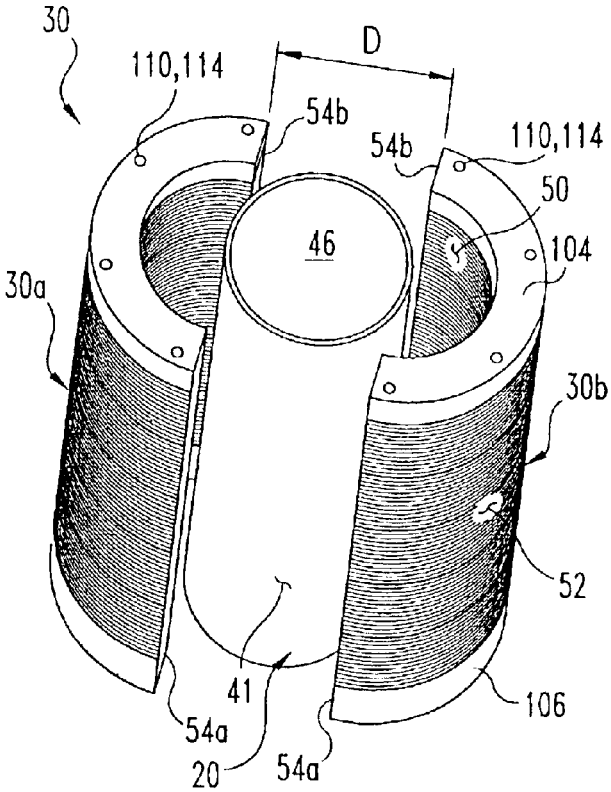
FIG. 3 is a perspective view of a thermal jacket according to one embodiment of the present invention, showing the thermal jacket in a disengaged position relative to a forming vessel.
Figure 4:
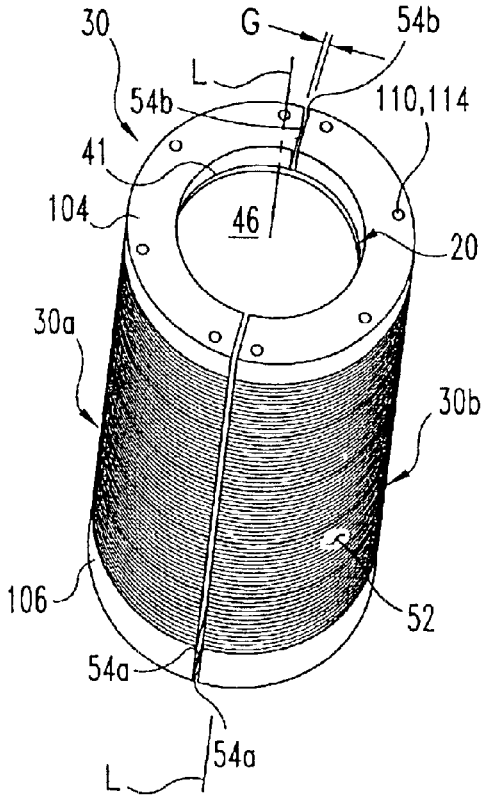
FIG. 4 is a perspective view of the FIG. 3 thermal jacket, showing the thermal jacket in an engaged position relative to the forming vessel.

Referring now to FIGS. 3–14, shown therein are various structural features regarding thermal jacket 30. As illustrated in FIG. 3, the halves 30*a*, 30*b* of thermal jacket 30 are capable of being spread apart a sufficient distance D to allow vessel 20 to be inserted therebetween while avoiding frictional interferences between the exterior surface 41 of vessel 20 and the inner surfaces 50. However, as illustrated in FIG. 4, once vessel 20 is disposed in the appropriate position along longitudinal axis L, the halves 30*a*, 30*b* are drawn together to place inner surfaces 50 into intimate contact with the exterior surface 41 of vessel 20 to effectuate conductive heat transfer therebetween. Notably, when the halves 30*a*, 30*b* are engaged against vessel 20, a gap G remains between the opposing longitudinal edges 54*a* and the opposing longitudinal edges 54*b*.

One function of gap G is to eliminate or at least reduce the distance between the exterior surface 41 of vessel 20 and the inner surfaces 50 of thermal jacket 30, especially in cases where the rates of thermal expansion/contraction vary significantly between vessel 20 and thermal jacket 30. In one embodiment, the gap G corresponds to the following function: $f_n=(\alpha_j*\pi*r_j*\Delta T_j)-(\alpha_v*\pi*r_v*\Delta T_v)$, where $\alpha_j$ is the thermal expansion coefficient of the thermal jacket halves 30*a*, 30*b*, $r_j$ is the radius of the inner surfaces 50 of halves 30*a*, 30*b*, $\Delta T_j$ is the maximum temperature change of the thermal jacket halves 30*a*, 30*b*, $\alpha_v$ is the thermal expansion coefficient of the vessel 20, $r_v$ is the radius of the exterior surface 41 of vessel 20, and $\Delta T_v$ is the maximum temperature change of the vessel 20. In a preferred embodiment, the gap G is at least as large as $f_n$. However, it should be understood that gap G may take on other sizes, including any size necessary to accommodate for differing rates of thermal expansion and contraction between vessel 20 and thermal jacket 30.

Figure 5:
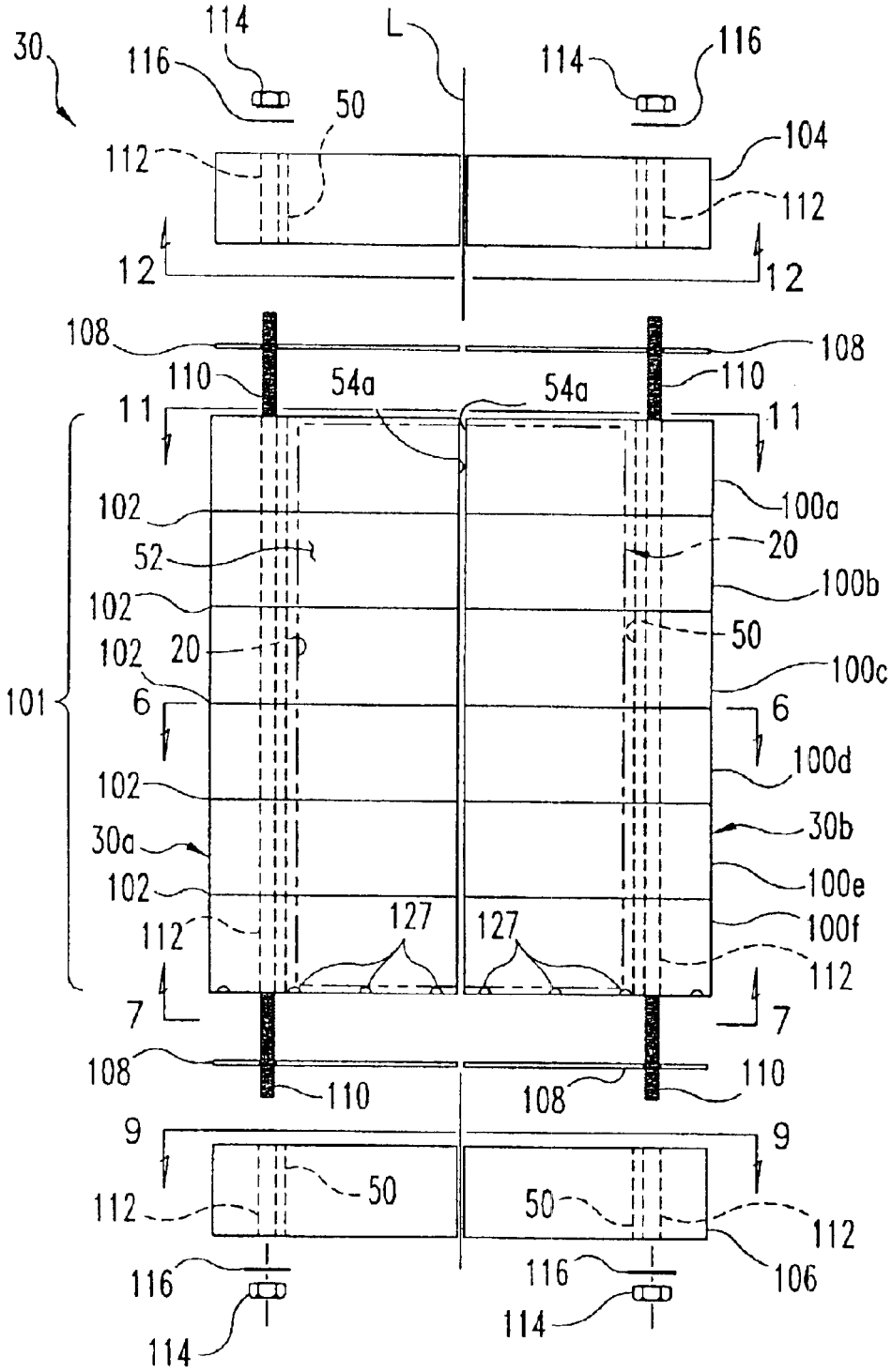
FIG. 5 is a partially exploded side elevational view of the FIG. 3 thermal jacket.

As shown in FIG. 5, in one embodiment of the present invention, thermal jacket 30 is made up of a number of individual axial sections 100*a*–100*f*, arranged in a stack along longitudinal axis L to define a main body portion 101. The separation of thermal jacket 30 into individual axial sections 100*a*–100*f* aids in reducing eddy currents which might otherwise develop in thermal jacket 30 were formed of a single axial piece, and also allows for better electromagnetic penetration of the magnetic field generated by stator 34. Although the illustrated embodiment shows main body portion 101 as being comprised of six axial sections, it should be understood that any number of axial sections may be used to provide thermal jacket 30 with varying heights. In one embodiment, each of the axial sections 100*a*–100*f* has a height of about 2 inches, providing main body portion 101 with an overall height of about 12 inches. It should also be understood that axial sections 100*a*–100*f* may alternatively be integrated to form a unitary, single piece main body portion 101.

Figure 6:
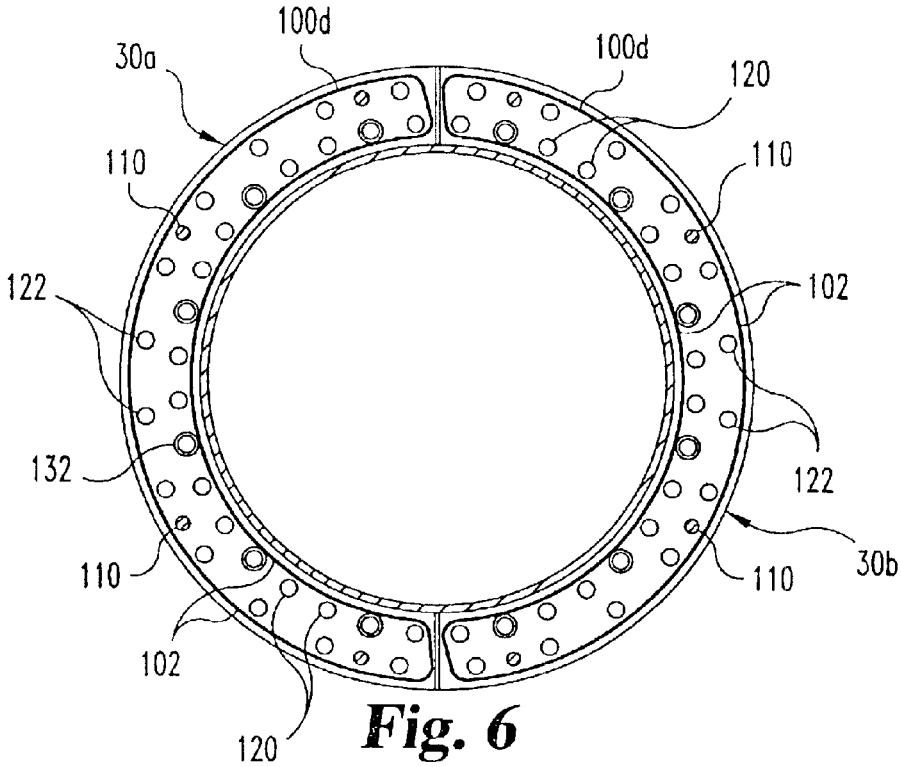
FIG. 6 is a cross sectional view of the FIG. 3 thermal jacket, as viewed along line 6—6 of FIG. 5.

As shown in FIGS. 5 and 6, each of the axial sections 100*a*–100*f* are preferably separated from one another by an electrically insulating material 102 to substantially eliminate, or at least minimize, magnetic induction losses through thermal jacket 30 during the operation of stator 34. In the illustrated embodiment, the insulating material 102 is in the form of a gasket and is made of any material having suitable insulating characteristics and capable of withstanding a high temperature environment. Such materials may include, for example, asbestos, ceramic fiber paper, mica, fluorocarbons, phenolics, or certain plastics including polyvinylchlorides and polycarbonates. Alternatively, the electrically insulating material 102 may comprise a coating of a conventional varnish or a refractory oxide layer applied to the abutting surfaces of axial sections 100*a*–100*f*. In either embodiment, the thickness of electrically insulating material 102 is preferably as thin as possible so as to avoid a significant decrease in the conductivity of thermal jacket 30. Preferably, the thickness of electrically insulating material 102 is in a range of about 0.063 inches to about 0.125 inches.

Thermal jacket 30 preferably includes an upper air manifold 104 and a lower air manifold 106, the purposes of which will be discussed below. A gasket material 108 is disposed between upper manifold 104 and axial section 100*a*, and between lower manifold 106 and axial section 100*f*, to provide a seal between the abutting surfaces, the importance of which will become apparent below. Gasket material 108 is made of any suitable material, such as, for example, asbestos, mica, fluorocarbons, phenolics, or certain plastics including polyvinylchlorides and polycarbonates. Gasket material 108 is arranged in a manner similar to insulating material 102 (FIG. 6) to form a continuous seal adjacent the peripheral edges of each half of upper and lower manifolds 104, 106. Preferably, the thickness of gasket material 108 is within a range of about 0.063 inches to about 0.125 inches.

Axial sections 100*a*–100*f*, upper manifold 104, and lower manifold 106 are joined together to form integrated thermal jacket halves 30*a*, 30*b*. In the illustrated embodiment, four threaded rods 110 are passed through corresponding openings 112 extending longitudinally along the entire length of each half 30*a*, 30*b*. However, it should be understood that any number of threaded rods could be used to join the axial sections 100*a*–100*f*. A nut 114 and washer 116 are disposed at each end of rod 110, with nut 114 being tightly threaded onto rod 110 to form substantially rigid thermal jacket halves 30*a*, 30*b*. Other suitable means for joining the axial sections and manifolds are also contemplated, such as, for example, by tack welding.

Figure 7:
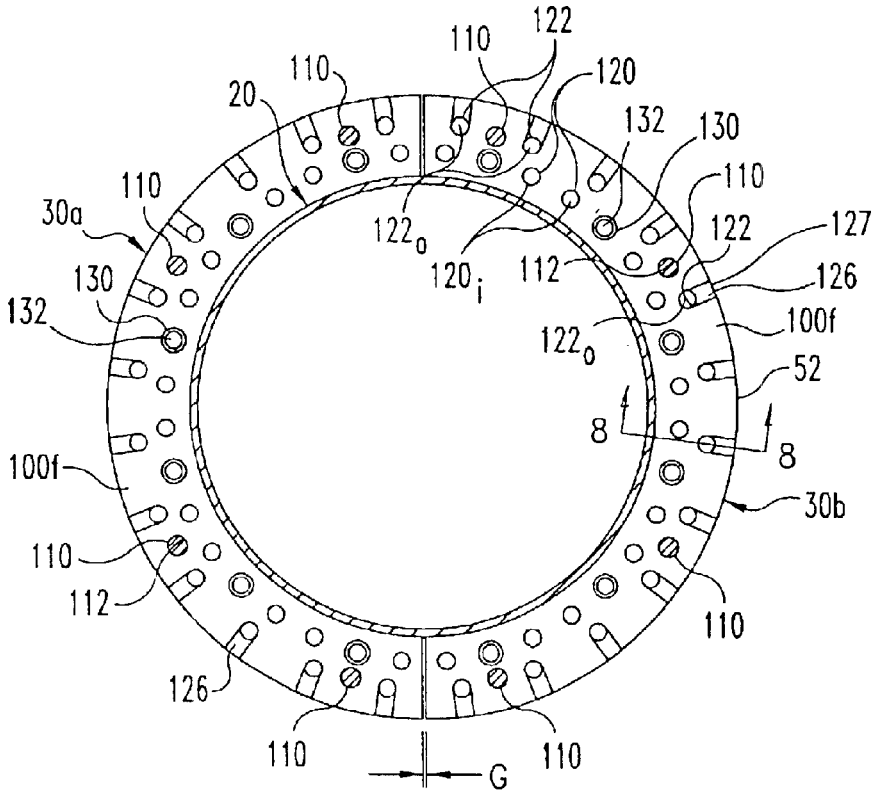
FIG. 7 is a bottom plan view of the main body of the FIG. 3 thermal jacket, as viewed along line 7—7 of FIG. 5.
Figure 8:
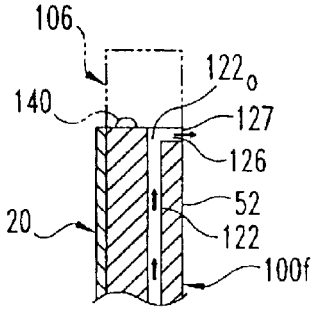
FIG. 8 is a partial cross sectional view of the FIG. 3 thermal jacket, as viewed along line 8—8 of FIG. 7.

Referring now to FIGS. 7–8, shown therein are various details regarding the lowermost axial section 100*f*. With regard to the following description of axial section 100*f*, except where noted, the features of axial section 100*f* apply equally as well to axial sections 100*a*–100*e*. Axial sections 100*a*–100*f* each include a plurality of inner axially extending passageways 120, and a corresponding plurality of outer axially extending passageways 120. Inner and outer passageways 120, 122 are disposed generally along longitudinal axis L and are dispersed circumferentially about thermal jacket halves 30*a*, 30*b*. The axial passageways 120, 122 of each axial section 100*a*–100*f* are correspondingly aligned to form substantially continuous axially extending passageways 120, 122, preferably running the entire length of main body portion 101. In the illustrated embodiment, there are twenty-four inner passageways 120 and twenty-four outer passageways 122; however, other quantities are also contemplated as being within the scope of the invention. The inner and outer passageways 120, 122 serve to transport a cooling media along the length of thermal jacket 30 to effectuate convective heat transfer between the cooling media and thermal jacket 30 and, as a result, extract heat from vessel 20 and the metal alloy contained therein. In a preferred embodiment, the cooling media is compressed air; however, other types of cooling media are also contemplated, such as, for example, other types of gases, or fluids such as water or oil.

The inner axial passageways 120 transport the cooling air from inlet openings 120*i*, defined by the lowermost axial section 100*f*, to outlet openings 120*o* (FIGS. 11 and 14), defined by the uppermost axial section 100*a*. Preferably, inner passageways 120 are semi-uniformly offset about the circumference of thermal jacket halves 30*a*, 30*b* to provide a relatively even extraction of heat from vessel 20. Additionally, inner passageways 120 are preferably radially positioned, in a uniform manner, adjacent inner surface 50 of thermal jacket 30 to minimize lag time between adjustments in cooling air flow rate and corresponding changes in the rate of heat extraction from vessel 20 and the metal alloy contained therein. However, other spacing arrangements and locations of inner passageways 120 are also contemplated as being within the scope of the invention. In one embodiment, the inner passageways 120 have a diameter of about 0.250 inches. However, other passageway sizes are also contemplated as being within the scope of the invention, with passageway size being determined by various design considerations, such as, for example, the desired cooling air flow rate, the heat transfer rate, and change in air temperature between the cooling air passageway inlets 120*i* and outlets 120*o*.

Figure 14:
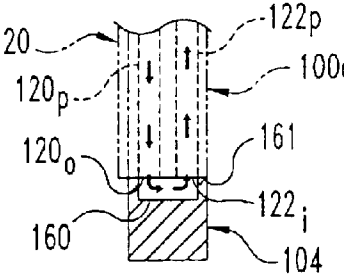
FIG. 14 is a partial cross sectional view of the FIG. 12 upper manifold, as viewed along line 14—14 of FIG. 12.
Figure 11:
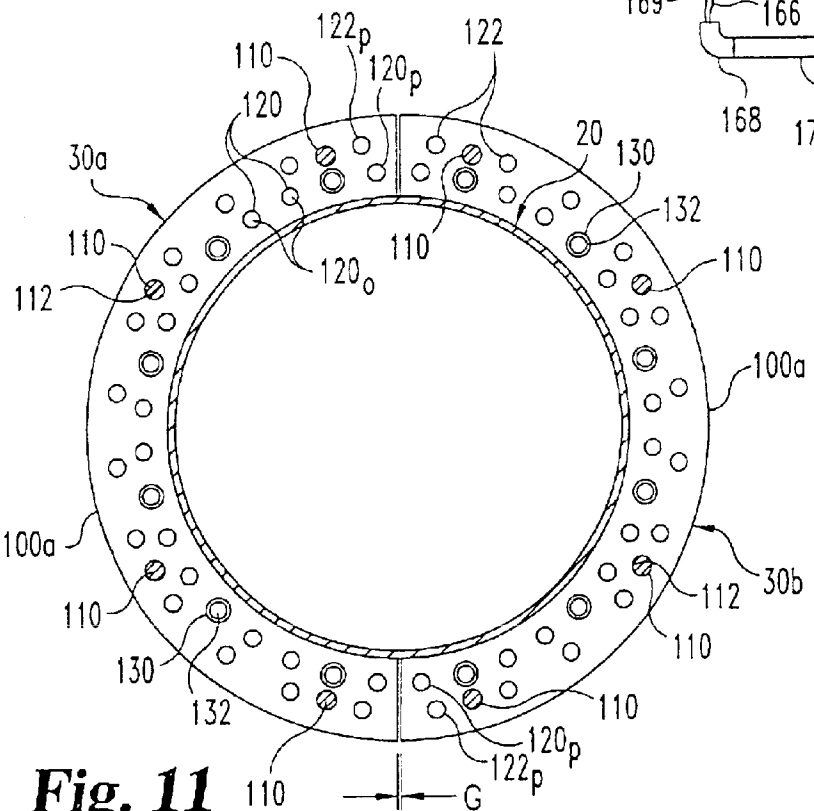
FIG. 11 is a top plan view of the main body of the FIG. 3 thermal jacket, as viewed along line 11—11 of FIG. 5.

As will be discussed in greater detail below, the cooling air exiting outlet openings 120*o* is redirected, by way of upper manifold 104, and fed into inlet openings 122*i* of outer axial passageways 122 (FIGS. 11 and 14). The outer passageways 122 transport the cooling air from inlet openings 122*i*, defined by the uppermost axial section 100*a*, to outlet openings 122*o*, defined by the lowermost axial section 100*f* (FIG. 7). Preferably, outer passageways 122 are uniformly offset about the circumference of thermal jacket halves 30*a*, 30*b* to provide a relatively even extraction of heat from vessel 20. Additionally, outer passageways 122 are preferably uniformly positioned radially outward of inner passageways 120. However, other spacing arrangements and locations of outer passageways 122 are also contemplated as being within the scope of the invention. For example, the outer passageways 122 could be disposed along the same radius as inner passageways 120 to reduce the thickness of thermal jacket halves 30*a*, 30*b*. In one embodiment, outer passageways 122 have a diameter of about 0.250 inches; however, other sizes are also contemplated as being within the scope of the invention.

The cooling air exiting outlet openings 122*o* is fed into a number of transverse notches 126, which are only defined in the lowermost axial section 100*f*, to exhaust the heat ladened cooling air to atmosphere. Transverse notches 126 extend between outer axial passageways 122 and the outer surface 52 of thermal jacket 30 in a direction substantially normal to longitudinal axis L, and cooperate with the lower manifold 106 to define exhaust ports 127 (additionally shown in FIG. 5). Thus, instead of exhausting the cooling air in a downward direction, where it may cause dust or debris to become airborne and possibly contaminate the system, the cooling air is directed in a lateral direction to avoid or at least minimize the potential for contamination.

Although the cooling air system has been illustrated and described as an open system, where the cooling air is ultimately discharged to atmosphere, it should be understood that a closed system could alternatively be used in which the cooling air is continually recirculated through thermal jacket 30. Such a closed system could include means for removing heat from the system, such as, for example, by a chiller, heat exchanger, or another type of refrigeration device. Additionally, although thermal jacket 30 has been illustrated and described as utilizing a two-pass cooling air route, it should be understood that thermal jacket 30 could alternatively be designed with a single-pass cooling air route to correspondingly reduce the thickness of thermal jacket halves 30*a*, 30*b*. It should also be understood that thermal jacket 30 could alternatively be designed with a multiple pass cooling air route, or with a continuous cooling air route extending spirally about a single piece thermal jacket 30.

Notably, inner passageways 120 are preferably disposed radially inward of outer passageways 122, adjacent the inner surface 50 of thermal jacket halves 30*a*, 30*b*, to maximize the heat transfer efficiency of thermal jacket 30. More specifically, the cooling air flowing through inner passageways 120 is at a lower temperature than the cooling air flowing through outer passageways 122. To maximize heat transfer efficiency, the inner passageways 120, which contain cooler air, are positioned closest to the location of highest temperature, namely at a location adjacent vessel 20. On the other hand, the outer passageways 122, which contain air that has been warmed through convective heat transfer, are positioned at a location of lower temperature. Thus, the particular placement of the inner and outer passageways 120, 122 serves to maximize the ability of thermal jacket 30 to extract heat from vessel 20 and the metal contained therein.

In addition to using forced air cooling to extract heat from vessel 20, thermal jacket 30 also preferably includes means for adding heat to vessel 20 to provide additional control over the temperature and cooling rate of the metal alloy. Axial sections 100*a*–100*f* each include a plurality of axially extending apertures 130, disposed generally along longitudinal axis L and dispersed circumferentially about thermal jacket halves 30*a*, 30*b*. The apertures 130 of each axial section 100*a*–100*f* are correspondingly aligned to form substantially continuous axial apertures 130 running the entire length of main body portion 101. Within each aperture 130 is disposed a heating element 132. In the illustrated embodiment, there are twelve apertures 130, each having a diameter of about 0.375 inches. Preferably, apertures 130 are uniformly offset about the circumference of thermal jacket halves 30*a*, 30*b* to provide a relatively even distribution of heat. Additionally, apertures 130 are preferably positioned along the same radius as inner cooling air passageways 120, adjacent inner surface 50 of thermal jacket 30, to maximize heat transfer efficiency and to minimize lag time between activation of heating elements 132 and the addition of heat to vessel 20 and the metal alloy contained therein. It should be understood, however, that other quantities, sizes, spacing arrangements and locations of apertures 130 are also contemplated as being within the scope of the invention. It should also be understood that other means for adding heat to vessel 20 may be incorporated into thermal jacket 30, such as, for example, a series of heating air passageways configured similar to cooling air passageways 120, 122 and adapted to carry a heated fluid, such as air.

Preferably, heating element 132 is of the cartridge type, defining a generally circular outer cross section and having a length approximately equal to the height of main body portion 101. In one embodiment, heating element 132 has a diameter of about 0.375 inches, an overall length of 12 inches, a temperature range between about 30° Celsius and about 800° Celsius, a power rating of about 1000 watts, and a heating capacity of about 3,400 BTU/hr. However, it should be understood that other types, styles and sizes of heating elements are also contemplated. Some factors to consider in the selection of a suitable heating element include the specific composition of the metal alloy being produced, the desired cycle time, the heating response/lag time, etc. An example of a suitable electrical cartridge heating element is manufactured by Watlow Electric Manufacturing Company of St. Louis, Mo. under Part No. G12A47; however, other suitable heating elements are also contemplated as would occur to one of ordinary skill in the art.

Figure 9:
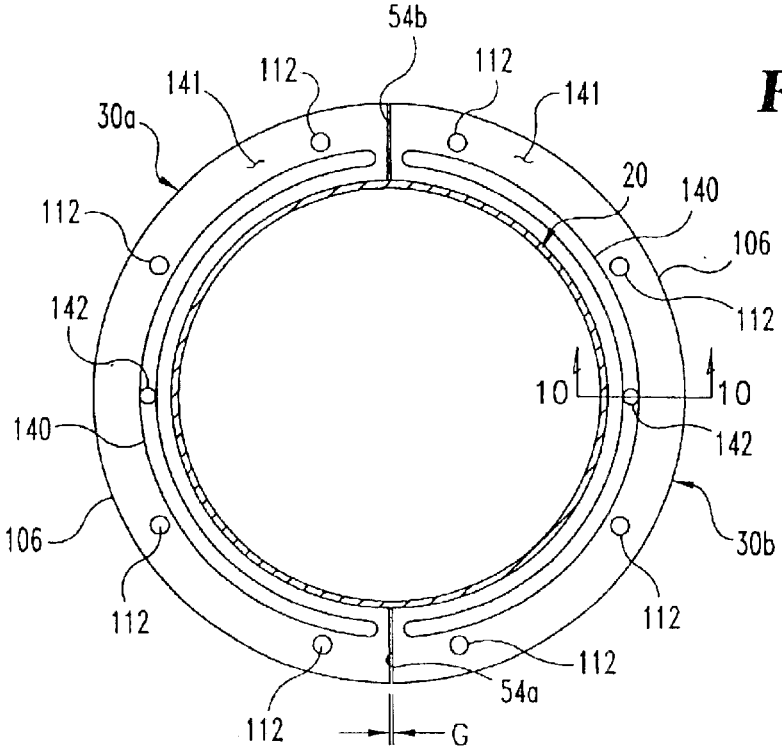
FIG. 9 is a top plan view of a lower manifold of the FIG. 3 thermal jacket, as viewed along line 9—9 of FIG. 5.
Figure 10:
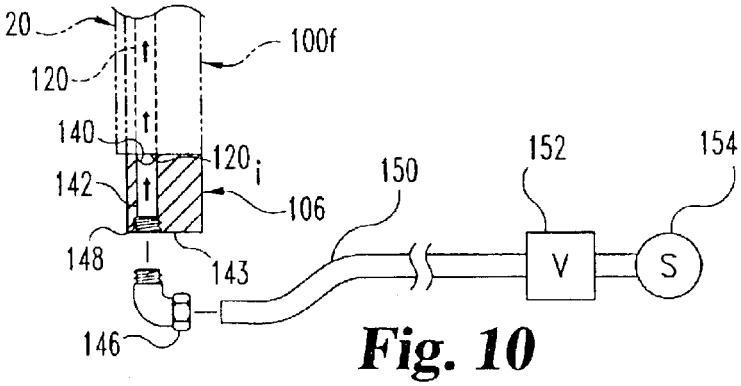
FIG. 10 is a partial cross sectional view of the FIG. 9 lower manifold, as viewed along line 10—10 of FIG. 9.

Referring now to FIGS. 9–10, shown therein are various details regarding the lower air manifold 106. In one embodiment, lower air manifold 106 has an outer profile corresponding to that of main body portion 101 and has a height of about 2 inches; however, other configurations and sizes of lower manifold 106 are also contemplated as would occur to one of ordinary skill in the art. Each half 30*a*, 30*b* of lower manifold 106 includes a circumferentially extending air distribution slot 140 defined in upper surface 141, continuously extending from a point adjacent longitudinal edge 54*a* to a point adjacent longitudinal edge 54*b*. Importantly, the slot 140 is positioned along the same radius as the inner cooling air passageways 120 and is placed in fluid communication with each of the inner passageways 120 when lower manifold 106 is attached to a respective half 30*a*, 30*b* of main body portion 101. Preferably, slot 140 has a width equal to or slightly greater than the diameter of inner passageways 120 and a depth equal to or greater than the width. In one embodiment, slot 140 has a width of about 0.250 inches and a depth of about 0.500 inches. Lower manifold 106 also defines an air inlet opening 142, extending between lower surface 143 and slot 140. Air inlet opening 142 preferably has a diameter approximately equal to the width of slot 140. An air inlet fitting 146 is threaded into an internally threaded portion 148 of inlet opening 142. An air supply conduit 150, preferably in the form of a flexible tube, is connected to air fitting 146. Thus, cooling air supplied through a single point conduit 150 is communicated to slot 140 and distributed to each of the inner cooling air passageways 120 via lower manifold 106.

A valving arrangement is provided, such as valve 152, to control the flow rate of air between a compressed air source 154 and the air supply conduit 150 leading to thermal jacket 30. Controlling the flow rate of cooling air in turn controls the rate of convective heat transfer between the thermal jacket 30 and the cooling air, which correspondingly controls the temperature and rate of heat extraction from the metal alloy contained within vessel 20. In a preferred embodiment, the valve 152 is an electrically operated metering valve capable of automatically controlling the flow rate of the cooling air. An example of a suitable electrically operated metering valve is manufactured by SMC of Indianapolis, Ind. under Part No. VY1D00-M5; however, other suitable electrical valves are also contemplated as would occur to one of ordinary skill in the art. It should be understood that valve 152 could alternatively be a manual valve, such as a hand-operated pressure regulator or any other suitable valve arrangement.

Referring now to FIGS. 11–14, shown therein are various details regarding the uppermost axial section 100*a* and upper air manifold 104. As mentioned above, the cooling air exiting outlet openings 120*o* of inner cooling air passageways 120 is redirected, by way of upper manifold 104, into inlet openings 122*i* of outer passageways 122. More specifically, a number of angled slots 160 are defined in the lower surface 161 of upper manifold 104. Importantly, each slot 160 has a length, orientation and location which positions slot 160 directly over a corresponding pair of inner and outer passageways 120*p*, 122*p* (FIG. 11) when upper manifold 104 is attached to main body portion 101. In this manner, slots 160 place corresponding pairs of passageways 120*p*, 122*p* in fluid communication with one another, thereby directing the air exiting inner passageways 120 into outer passageways 122. Preferably, slot 160 has a width approximately equal to or greater than the larger diameter of inner and outer passageways 120, 122, and a depth equal to or greater than the width. In one embodiment, slot 160 has a width of about 0.250 inches and a depth of about 0.500 inches. In an alternative embodiment, the bottom of slot 160 may be rounded to provide a smoother transition between inner and outer passageways 120, 122, thereby reducing the pressure drop across upper manifold 104. In another embodiment of upper manifold 104, the individual slots 160 may be replaced by a circumferentially extending slot continuously extending from a point adjacent longitudinal edge 54*a* to a point adjacent longitudinal edge 54*b*, and positioned in fluid communication with each of the outlet openings 120*o* and the inlet openings 122*i*.

Figure 13:
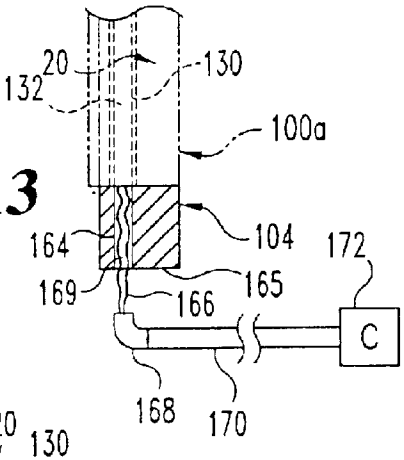
FIG. 13 is a partial cross sectional view of the FIG. 12 upper manifold, as viewed along line 13—13 of FIG. 12.
Figure 12:
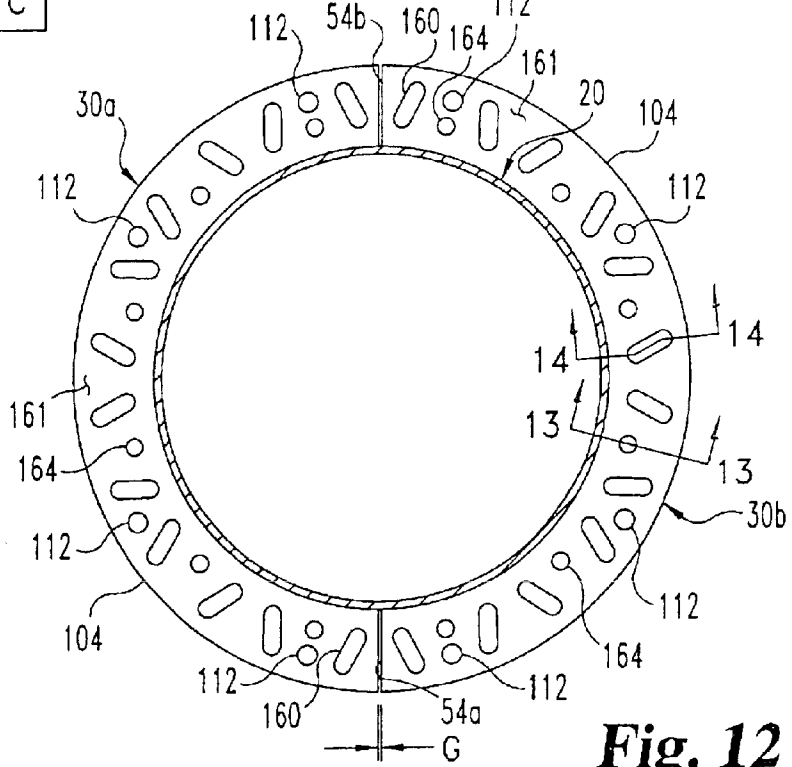
FIG. 12 is a bottom plan view of an upper manifold of the FIG. 3 thermal jacket, as viewed along line 12—12 of FIG. 5.

Referring to FIGS. 12–13, shown therein is one method of wiring heating elements 132; however, it should be understood that other wiring methods are also contemplated as being within the scope of the invention. Specifically, upper manifold 104 defines a number of exit apertures 164 extending therethrough between bottom surface 161 and top surface 165. Each of the exit apertures 164 are aligned with corresponding ones of the heating element apertures 130 when upper manifold 104 is attached to main body portion 101. The electrical leads 166 extending from the end of heating elements 132 are passed through exit apertures 164 to a location outside of upper manifold 104. Electrical leads 166 are routed through an air-tight electrical connector 168, which in turn is threaded into an internally threaded portion 169 of exit aperture 164. The leads 166 are then preferably routed through an electrical cable 170 and wired to a heating element controller 172. An example of a suitable heating element controller is manufactured by Watlow Electric Manufacturing Company of Winona, Minn. under Part No. DC 1V-6560-F051; however, other suitable controllers are also contemplated as would occur to one of ordinary skill in the art.

Preferably, a programmable logic controller (not shown) or another similar device is employed to automatically control the cooling rate of the metallic melt contained within vessel 20, such as through closed-loop PID control, as well as control or monitor other system parameters and characteristics. For example, the programmable logic controller (or PLC) may be configured to regulate the flow rate of cooling air by controlling the operation of control valve 152, and to activate the heating elements 132 by controlling the operation of heating element controller 172. Additionally, the PLC may be used to control the extension/retraction of the pneumatic cylinders 76, 78 and/or the operation of transport mechanism 26. The PLC could also be used to monitor various temperature sensors or thermocouples adapted to provide closed-loop feedback to provide increased control over the temperature and cooling rate of the metallic melt contained within vessel 20. Additionally, the PLC could be used to control the operation of other devices used within the system, such as stator 34 or induction coil 36.

Following is a summarization of the operation of thermal jacket 30 with regard to controlling the temperature and cooling rate of the metallic melt. As discussed above, thermal jacket 30 preferably has the capacity to control the cooling rate of the metal alloy contained in vessel 20 within a range of about 0.1° Celsius to about 10° Celsius per second. The importance of maintaining such tight control over temperature and cooling rate is to regulate the solidification of the liquid metal to a semi-solid slurry to ensure the desired semi-solid forming process parameters and material properties are satisfied. Additionally, the short cycle times associated with the semi-solid forming process of the present invention require a relatively higher degree of control over temperature and cooling rate than do prior forming processes exhibiting lengthier cycle times. Further, it has been found that by controlling the initial temperature of vessel 20 prior to the introduction of the metallic melt, the cycle time associated with the semi-solid forming process can be effectively reduced.

Following the clamping of thermal jacket 30 into intimate engagement with the exterior surface 41 of vessel 20, liquid metal is introduced into vessel 20. Almost instantaneously, heat begins to shift from the liquid metal to the sidewall 40 of vessel 20 through both conductive and convective heat transfer. As the temperature of sidewall 40 rises, heat is transferred, primarily through conduction, from sidewall 40 to the thermal jacket halves 30*a*, 30*b*. Acting as a heat sink, thermal jacket halves 30*a*, 30*b* quickly and efficiently dissipate heat to the surrounding environment through convective heat transfer to the pressurized air flowing through cooling air passageways 120, 122, which in turn is discharged to atmosphere through air exhaust ports 127. Heat is also dissipated to the surrounding environment through convective heat transfer by way of air currents flowing across the exposed outer surfaces of thermal jacket 30.

By regulating the amount of air flowing through cooling air passageways 120, 122, a certain degree of control is obtained over the temperature and cooling rate of the metal alloy contained within vessel 20. For example, by increasing the flow rate of air passing through passageways 120, 122, a greater amount of heat is dissipated to the surrounding environment, which in turn correspondingly lowers the temperature of thermal jacket 30. By lowering the temperature of thermal jacket 30, the rate of heat transfer between vessel 20 and thermal jacket 30 is increased, which correspondingly increases the rate of heat extraction from the metal alloy contained within vessel 20, thereby decreasing its temperature and increasing its cooling rate. Likewise, decreasing the amount of air passing through passageways 120, 122 has the effect of correspondingly decreasing the cooling rate of the metal contained within vessel 20. In another embodiment of the invention, the inlet temperature of the cooling air introduced into thermal jacket 30 can be varied to provide additional control over the temperature and cooling rate of the metal alloy contained in vessel 20.

Since temperature and cooling rates are somewhat difficult to control through forced air cooling alone, heating elements 132 are included to provide an added degree of control. Since adjustments made to an electrical control circuit are typically more precise than adjustments made to a pneumatic control circuit, the inclusion of electrical heating elements 132 provides a greater degree of precision to the overall control scheme. More specifically, heating elements 132 are integrated into the control scheme to provide a type of feedback-controlled electric heating circuit. If the forced air cooling circuit overshoots the target temperature or target cooling rate (i.e., too low of a temperature, or too fast of a cooling rate), activation of the heating elements 132 stabilizes the system and restores the system to the desired target temperature and the desired target cooling rate. The cycle time of heating elements 132 is dependant on the heating capacity of heating elements 132, the desired amount of precision in the control circuit, the lag time inherent in the electrical and pneumatic control circuits, the target temperature and rate of cooling, and other factors which affect the transfer of heat. As discussed above, heating elements 132 can also be used to preheat vessel 20 prior to the introduction of liquid metal to avoid the formation of a solidified skin. Preferably, vessel 20 should be preheated to avoid premature solidification or skinning.

It should be understood that the heating/cooling capacity of thermal jacket 30 can be modified to accommodate other semi-solid forming processes or to produce particular compositions of metal or metal alloy. For example, the heating/cooling capacity of thermal jacket 30 can be modified by changing the number, size or location of the cooling passageways 120, 122, by increasing/decreasing the inlet temperature or flow rate of the cooling air, by adding/removing heating elements 132 or changing the heating capacity, cycle time, or location of heating elements 132, by modifying the aspect ratio of vessel 20 and/or thermal jacket 30, or by making vessel 20 and/or thermal jacket 130 out of a different material.

Figure 15:
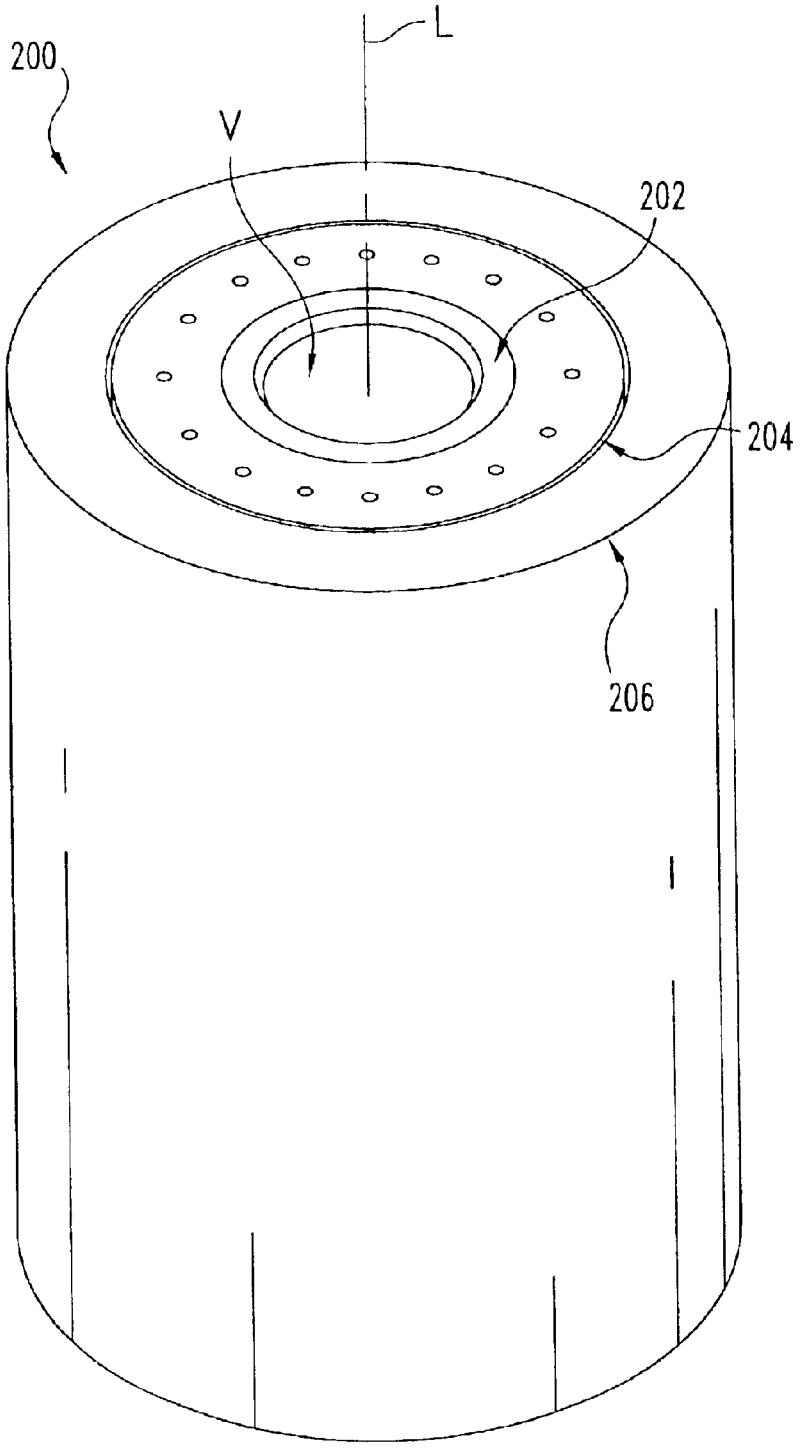
FIG. 15 is a side perspective view of an apparatus according to another form of the present invention for use in producing a metallic slurry material for in semi-solid forming of shaped parts.

Referring to FIG. 15, shown therein is an apparatus 200 according to another form of the present invention for producing a metallic slurry material for use in semi-solid forming of shaped parts. The apparatus 200 extends along a longitudinal axis L and is generally comprised of a forming vessel or crucible 202 defining an inner volume V for containing a metallic melt, and a thermal jacket 204 for controlling the temperature and cooling rate of the metallic melt contained within the forming vessel 202. Further features of the forming vessel 202 and the thermal jacket 204 will be discussed below.

In the illustrated embodiment of the invention, an electromagnetic stator 206 is disposed about the thermal jacket 204 and is adapted to impart an electromagnetic stirring force to the metallic melt contained within the forming vessel 202. In one embodiment of the invention, the electromagnetic stator 206 has a cylindrical shape and is positioned along the longitudinal axis L, generally concentric with the forming vessel 202 and the thermal jacket 204. The electromagnetic stator 206 is preferably a multiple-pole, multiple-phase stator and can be of a rotary type, a linear type, or a combination of both. The magnetic field created by stator 206 preferably moves about the forming vessel 202 in directions either substantially normal or substantially parallel to the longitudinal axis L, or a combination of both. One example of an electromagnetic stator suitable for use with the present invention is disclosed in U.S. Pat. No. 6,402,367 to Lu et al., the contents of which are expressly incorporated by reference. It should be understood, however, that other types of devices may be used to stir the metallic material contained within the forming vessel 202, such as, for example, a mechanical stirring device or other types of agitation devices as would be apparent to one of skill in the art. It should also be understood that in other embodiments of the invention, the metallic slurry material may be formed within the forming vessel 202 without stirring or any other form of agitation. An example of such an embodiment is disclosed in U.S. patent application Ser. No. 09/932,610 to Winterbottom et al. filed on Aug. 12, 2001, the contents of which are expressly incorporated by reference.

Figure 16:
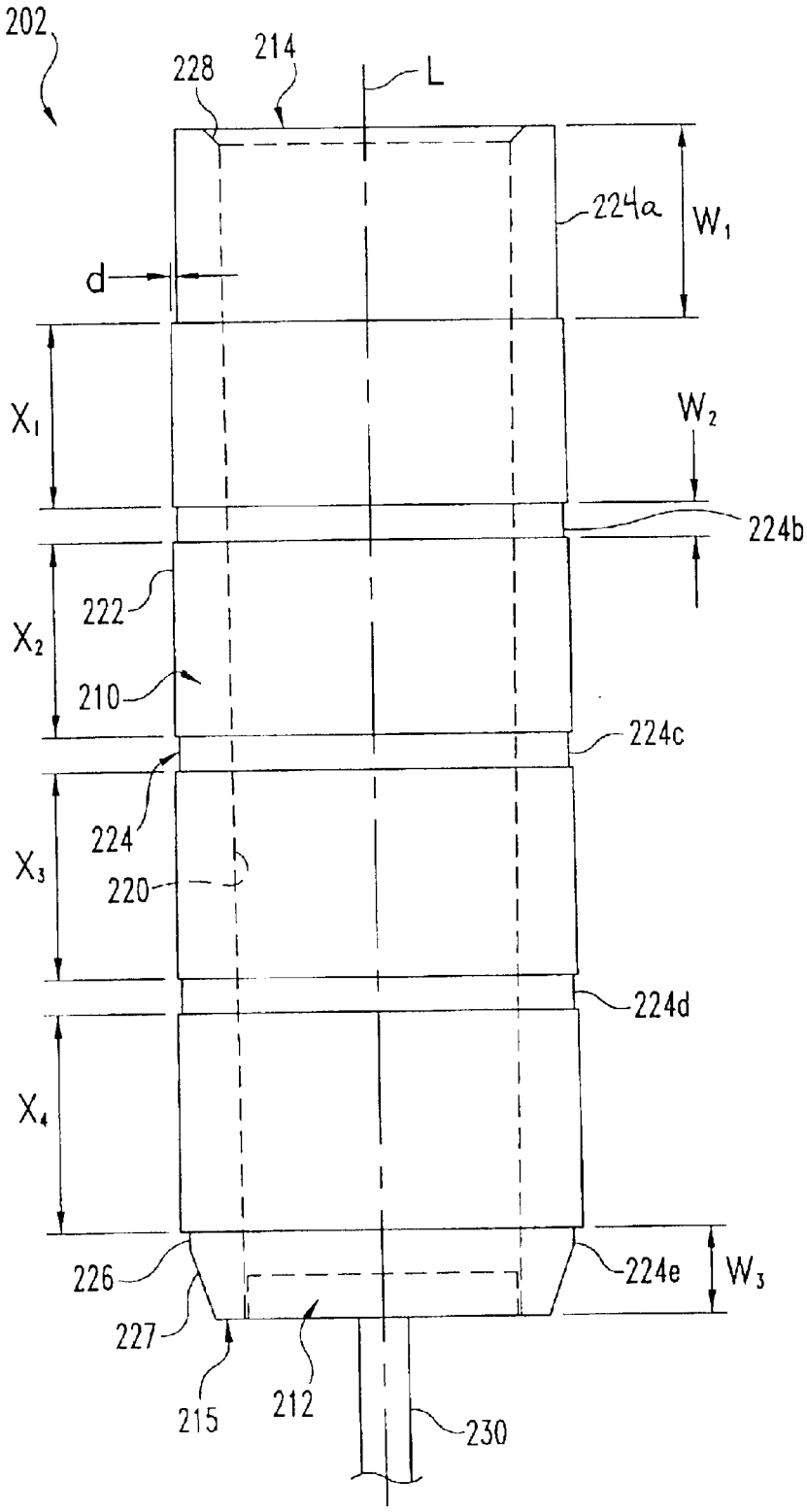
FIG. 16 is a side elevational view of a temperature-controlled forming vessel according to one embodiment of the present invention for use in association with the apparatus illustrated in FIG. 15.
Figure 17:
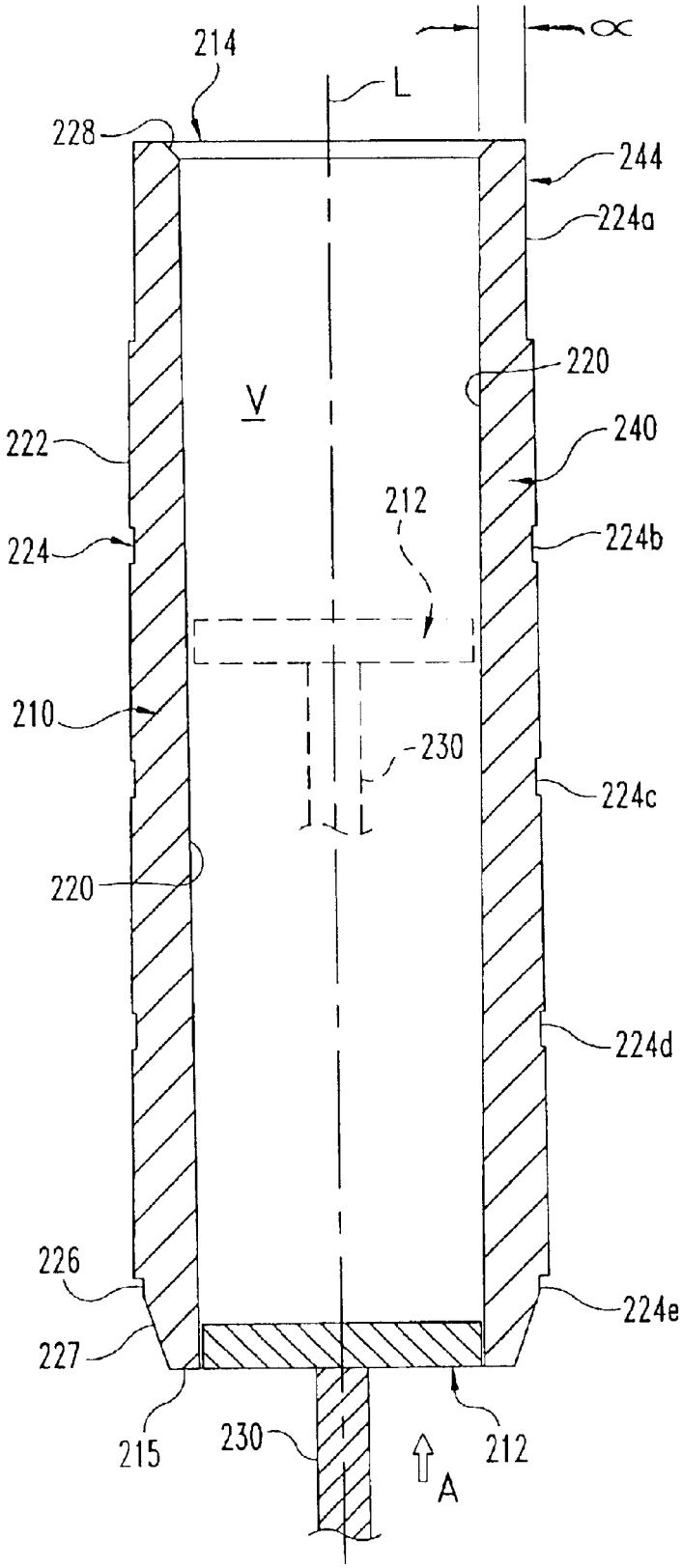
FIG. 17 is a side cross sectional view of the temperature-controlled forming vessel illustrated in FIG. 16.

Referring to FIGS. 16 and 17, shown therein are further details regarding the forming vessel 202. The forming vessel 202 includes an axial side wall 210, a bottom wall 212, an open end 214, and a closed end 215. The side wall 210 and the bottom wall 212 cooperate to define the inner volume V of the forming vessel 202. The open end 214 is configured to provide an opening for charging molten metal into the inner volume V of the forming vessel 202 and for subsequently discharging metallic slurry material therefrom. In another embodiment of the invention, the open end 214 may be selectively covered by a removable lid (not shown) to enclose the inner volume V of the forming vessel 202 during formation of the metallic slurry material.

In one embodiment of the invention, the forming vessel 202 has a can-like configuration, with the side wall 210 having a cylindrical shape and the bottom wall 212 having a disc shape. However, it should be understood that other shapes and configurations of the forming vessel 202 are also contemplated, such as, for example, square, polygon or elliptical shapes, or any other shape as would be apparent to one of ordinary skill in the art. The forming vessel 202 is preferably formed of a non-magnetic material having low thermal resistance, good electromagnetic penetration capabilities, good corrosion resistance, and relatively high strength at high temperatures. By way of example, the forming vessel 202 may be formed of materials including, but not limited to, graphite, stainless steel, or a ceramic material. To provide additional resistance to attack by reactive alloys, such as molten aluminum, and to aid in discharging the metallic slurry material after the forming process is completed, the inner surfaces of the vessel 202 may be coated or thermally sprayed with boron nitride, a ceramic coating, or any other suitable material.

The side wall 210 of the forming vessel 202 includes an inwardly facing surface 220 and an outwardly facing surface 222. In one form of the invention, the side wall 210 defines a number of grooves 224 extending inwardly from the outer surface 222 toward the inner surface 220, the purpose of which will be discussed below. As will also be discussed below, a number of such grooves may additionally or alternatively be defined by the side wall of the thermal jacket 204. In one embodiment of the invention, the grooves 224 extend about the periphery of the forming vessel 202. However, it should be understood that some or all of the grooves 224 may alternatively extend in an axial direction along the longitudinal axis L. In another embodiment of the invention, the grooves 224 extend about the entire outer periphery of the forming vessel 202 so as to define a number of circumferentially-extending grooves. However, it should be understood that some or all of the grooves 224 may alternatively extend partially about the outer periphery of the forming vessel 202. It should also be understood that in other embodiments of the invention, the forming vessel 202 may define a continuous groove 224 extending helically or spirally about the outer periphery of the forming vessel 202.

In the illustrated embodiment of the invention, the forming vessel defines a plurality of circumferentially-extending grooves 224*a*–224*e* that are axially-offset relative to one another by distances $X_1$–$X_4$. In one embodiment, the grooves 224*a*–224*e* are offset from another by non-uniform axial distances $X_1$–$X_4$, with the axial distances $X_1$–$X_4$ gradually increasing from the open end 214 toward the closed end 215. As also shown in the illustrated embodiment, the grooves 224*a*–224*e* need not necessarily have the same axial width, but can instead define varying axial widths. For example, the groove 224*a* disposed adjacent the open end 214 has a groove width $W_1$ that is somewhat greater than the axial width of the remainder of the grooves 224*b*–224*e*. The intermediate grooves 224*b*–224*d* have a substantially uniform groove width $W_2$, while the groove 224*e* disposed adjacent the bottom wall 212 has an axial groove width $W_3$ that is somewhat greater than the axial width $W_2$ of the intermediate grooves 224*b*–224*d*.

As also shown in the illustrated embodiment, the grooves 224*a*–224*e* define a substantially uniform groove depth d. However, it should be understood that the grooves 224*a*–224*e* may alternatively define non-uniform or varying groove depths d. In one embodiment of the invention, the grooves 224*a*–224*e* each define an axial groove width $W_1$–$W_3$ that is significantly greater than the groove depth d. In a specific embodiment, the axial groove width $W_1$–$W_3$ is at least twice the groove depth d. However, it should be understood that other arrangements, sizes and configurations of the grooves 224*a*–224*e* are also contemplated as falling within the scope of the present invention. Additionally, although the grooves 224*a*–224*d* have a generally rectangular cross-section, other shapes and configurations of grooves are also contemplated. For example, the groove 224*e* disposed adjacent the bottom wall 212 has an irregular shape, including a first rectangular-shaped portion 226 arranged generally parallel with the outer surface 222 of the forming vessel and a second tapered portion 227 arranged at an angle relative to the outer surface 222. In other embodiments of the invention, the grooves 224*a*–224*e* may be take on an angular or polygonal configuration, such as, for example, a V-shaped notch, and/or an arcuate configuration, such as, for example, a circular or elliptical notch.

As most clearly illustrated in FIG. 17, in one embodiment of the invention, the inner surface 220 of the forming vessel 202 defines an outward taper extending from the closed end 215 toward the open end 214. The outward taper defines a draft angle $\alpha$ which aids in the discharge of the metallic slurry material from the forming vessel 202. The inner surface 220 also defines an outwardly extending chamfer 228 adjacent the open end 214 to further aid in the discharge of the metallic slurry material from the forming vessel 202. In another embodiment of the invention, the bottom wall 212 is axially displacable along the inner volume V (as shown in phantom) to discharge the metallic slurry material from the forming vessel 202. In one embodiment, an actuator rod or piston 230 is coupled to the bottom wall 212 such that axial displacement of the actuator rod 230 in the direction of arrow A correspondingly displaces the bottom wall 212 along the inner volume V to discharge the metallic slurry material from the forming vessel 202. It should be understood, however, that other means and methods for discharging the metallic slurry material from the forming vessel 202 are also contemplated. Examples of alternative means and methods for discharging the metallic slurry material from a forming vessel are disclosed in U.S. Pat. No. 6,399,017 to Norville et al., the contents of which are expressly incorporated by reference.

Figure 18:
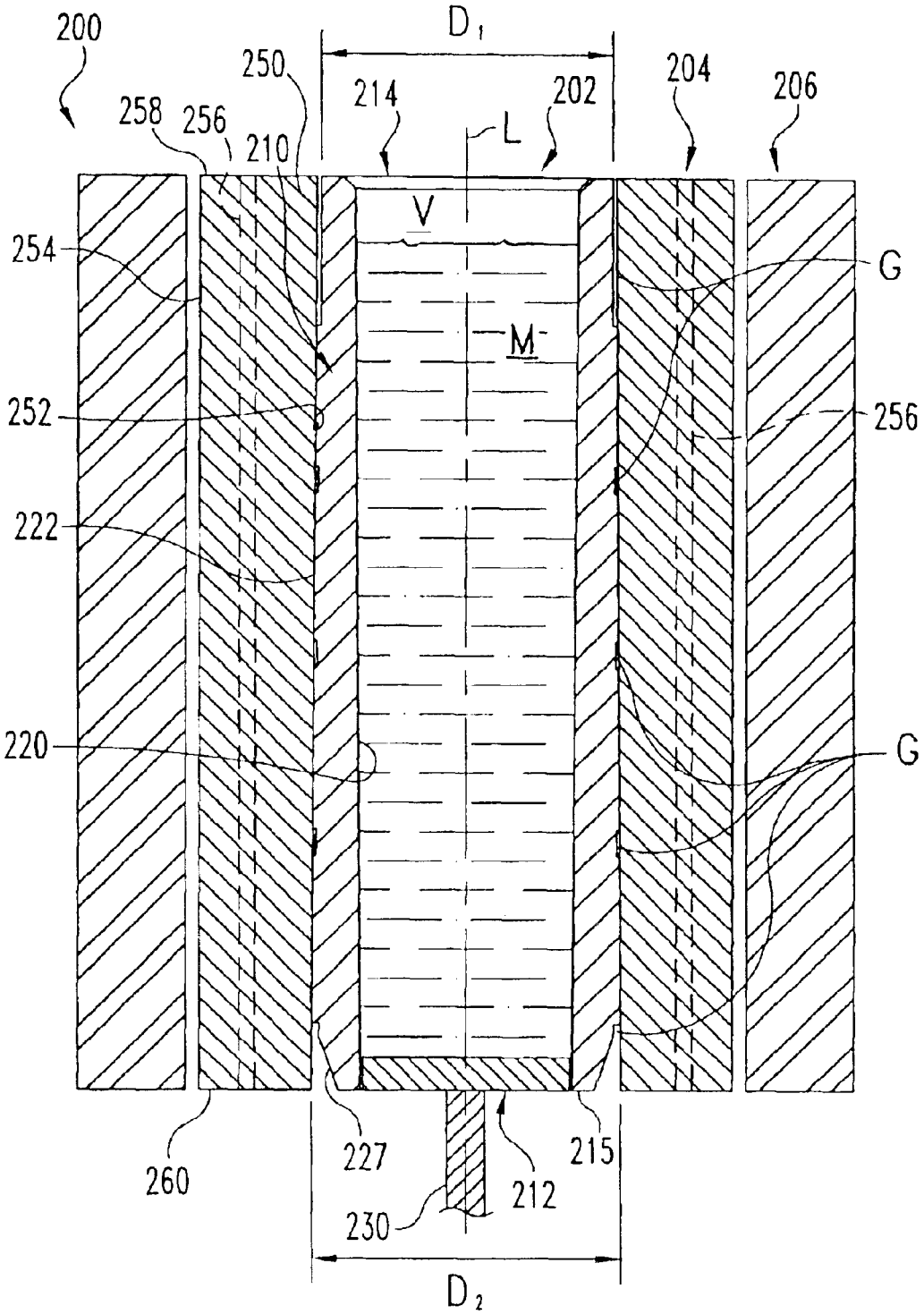
FIG. 18 is a side cross sectional view of the apparatus illustrated in FIG. 15, as shown in a substantially vertical orientation during production of the metallic slurry material.

Referring to FIG. 18, illustrated therein is a cross-sectional view of the apparatus 200, with the forming vessel 202 disposed in thermal communication with the thermal jacket 204 to effectuate heat transfer therebetween. As should be apparent, heat transfer between the thermal jacket 204 and the forming vessel 202 in turn facilitates heat transfer between the forming vessel 202 and the metallic melt M contained within the inner volume V of the forming vessel 202. Further details regarding the interrelationship between the thermal jacket 204 and the forming vessel 202 will be discussed below.

The thermal jacket 204 includes an axial side wall 250 extending generally along the longitudinal axis L and defining an inner surface 252 and an outer surface 254. In the illustrated embodiment of the invention, the thermal jacket 204 has a substantially cylindrical configuration, with the inner and outer surfaces 252, 254 having a generally circular shape. However, it should be understood that other shapes and configurations of the thermal jacket 204 are also contemplated, including square, rectangular, polygonal or elliptical configurations. The inner surface 252 of the thermal jacket 204 is preferably substantially complementary to the outer surface 222 of the forming vessel 202 such that the outer vessel surface 222 is positioned proximately adjacent the inner jacket surface 252 when the forming vessel 202 is positioned within the thermal jacket 204. Although the thermal jacket 204 has been illustrated and described as a single-piece structure, it should be understood that the thermal jacket 204 may alternatively be formed of two or more portions, such as, for example, the multi-portion thermal jacket 30 illustrated and described above.

The outer surface 254 of the thermal jacket 204 is preferably substantially complementary to the inner surface of the stator 206 to allow the stator 206 to be symmetrically positioned about the thermal jacket 204 and the forming vessel 202. Symmetric positioning of the stator 206 relative to the forming vessel 202 tends to provide more accurate and uniform control over the electromagnetic stirring force exerted onto the metallic melt M contained with the forming vessel 202. In order to minimize effects on the electromagnetic field generated by the stator 206, the side wall 250 of the thermal jacket 204 is preferably formed of a non-magnetic material having good electromagnetic penetration capabilities. Additionally, because the primary purpose of thermal jacket 204 is to facilitate heat transfer, the side wall 250 is preferably formed of a material having high thermal conductivity. Since the heat transfer capability of the thermal jacket 204 is influenced by material density, specific heat and thickness, consideration must be given to these factors as well. Further, the thermal jacket 204 should preferably be formed of a material having a coefficient of thermal expansion which is near that of the forming vessel 202 such that the thermal jacket 204 and the forming vessel 202 expand and contract at approximately the same rate. By way of example, the thermal jacket 204 may be formed of materials including, but not limited to, brass, copper or aluminum. However, other material are also contemplated as would be apparent to one of skill in the art.

The thermal jacket 204 is equipped with means for facilitating heat transfer with the forming vessel 202, and indirectly with the metallic slurry material M contained within the inner volume V of the forming vessel 202. In one embodiment of the invention, the thermal jacket 204 defines a number of passageways 256 extending axially through the side wall 250 from the top end 258 to the bottom end 260. The passageways 256 are adapted to direct a heat transfer media along the length of the side wall 250 to effectuate heat transfer between the heat transfer media and thermal jacket 204 and, as a result, to transfer heat from/to the forming vessel 202 and the metallic melt M contained within the inner volume V. Further details regarding other features and devices which may be used in association with the thermal jacket 204 to effectuate heat transfer with the forming vessel 202 are illustrated and described above with regard to the thermal jacket 30. Although not specifically illustrated in the drawing figures, it should be understood that the forming vessel 202 may also define a number of passageways adapted to direct a heat transfer media along the length of the side wall 210 to provide further control over the heat transfer between the forming vessel 202 and the metallic melt M contained within the inner volume V.

In a specific embodiment of the invention, the heat transfer media flowing through the passageways 256 is compressed air. However, other types of heat transfer media are also contemplated, such as, for example, other types of gases, or fluids such as water or oil. Manifolds may be provided to direct the flow of the heat transfer media into and out of the passageways 256, such as, for example, the manifolds 104 and 106 described above with regard to the thermal jacket 30. In other embodiments of the invention, the thermal jacket 204 may be provided with one or more electrical devices configured to add heat to the forming vessel 202 and the metallic melt M contained therein to provide a greater degree of control over the heat transfer rate between the thermal jacket 204 and the vessel 202.

As illustrated in FIG. 18, in order to effectuate heat transfer between the forming vessel 202 and the thermal jacket 204, the outer vessel surface 222 is positioned in thermal communication with the inner jacket surface 252. In a preferred embodiment of the invention, the outer vessel surface 222 is positioned in close proximity with the inner jacket surface 252 to effectuate heat transfer therebetween. In a more specific embodiment, the portions of the outer vessel surface 222 between the grooves 224*a*–224*e* are positioned in immediate proximity to and preferably in abutment against the inner jacket surface 252 to facilitate conductive heat transfer therebetween. The portions of the forming vessel 202 defined by the grooves 224*a*–224*e* are spaced from the inner jacket surface 252 to define a series of gaps G between the forming vessel 202 and the thermal jacket 204 to facilitate convective heat transfer therebetween. As a result, the rate of heat transfer between the forming vessel 202 and the thermal jacket 204 is limited or regulated in the areas laterally adjacent the grooves 224*a*–224*e* due to the inclusion of the gaps G.

As should be appreciated, the rate of heat transfer in the areas adjacent the grooves 224*a*–224*e* will be somewhat less than the rate of heat transfer between the portions of the outer vessel surface 222 positioned in immediate proximity to the inner jacket surface 252. As should also be appreciated, limiting or regulating the rate of heat transfer between the forming vessel 202 and the thermal jacket 204 in the areas adjacent the grooves 224*a*–224*e* will correspondingly limit the rate of heat transfer between the forming vessel 202 and the metallic melt M in the areas positioned laterally adjacent the grooves 224*a*–224*e*. The size and configuration of the grooves 224*a*–224*e*, in combination with the strategic placement of the grooves 224*a*–224*e* along the length of the forming vessel 202, controls or otherwise regulates the rate of heat transfer between the metallic melt M and the forming vessel 202.

By limiting the rate of heat transfer in the areas adjacent the grooves 224*a*–224*e*, the amount of heat extracted from or added to the metallic melt M can be more accurately controlled to provide the metallic melt M with a predetermined viscosity and microstructure that is substantially uniform and homogenous along the axial length of the forming vessel 202. Notably, the width $W_1$ of the groove 224*a* is somewhat greater than the width of the remaining grooves 224*b*–224*e*, thereby limiting the rate of heat transfer to a greater degree adjacent the groove 224*a* in comparison to the rate of heat transfer adjacent the grooves 224*b*–224*e*. The limited rate of heat transfer between the forming vessel 202 and the thermal jacket 204 in the area adjacent the groove 224*a* tends to compensate for convective heat losses from the metallic melt M to the surrounding environment adjacent the top 214 of the vessel 202. Similarly, the width $W_3$ of the groove 224*e* is somewhat greater than the width of the grooves 224*b*–224*d*, thereby limiting the rate of heat transfer to a greater degree adjacent the groove 224*e* in comparison to the rate of heat transfer adjacent the grooves 224*b*–224*d*. Additionally, the rate of heat transfer is further limited by the increased width of the gap G formed between the tapered surface 227 defined by the groove 224*e* and the inner wall 252 of the thermal jacket 204. The limited rate of heat transfer between the forming vessel 202 and the thermal jacket 204 in the area adjacent the groove 224*e* tends to compensate for conductive heat losses from the metallic melt M to the bottom wall 212 of the vessel 202.

In the illustrated embodiment of the invention, the gaps G formed by the grooves 224*a*–224*e* of the vessel 202 are air gaps. In this embodiment, the heat transfer across the air gaps G is convective heat transfer. However, it should be understood that in an alternative embodiment of the invention, the gaps G may be filled with an insulating material having lower thermal conductivity than the side wall 210 of the forming vessel 202. In this alternative embodiment, the heat transfer across the material-filled gaps G will be conductive heat transfer. However, the same effect of limiting or regulating heat transfer in the areas laterally adjacent the grooves 224*a*–224*e* will be maintained. As should be appreciated, the rate of heat transfer in the areas adjacent the grooves 224*a*–224*e* would be somewhat less than the rate of heat transfer between the portions of the outer vessel surface 222 positioned in immediate proximity to the inner jacket surface 252 due to the lower thermal conductivity of the insulating material disposed within the gaps G. In other embodiments of the invention, the gaps G may be filled with a conductive material having a higher thermal conductivity than the side wall 210 of the forming vessel 202. In this embodiment, the rate of heat transfer in the areas adjacent the grooves 224*a*–224*e* would be somewhat greater than the rate of heat transfer between the portions of the outer vessel surface 222 positioned in immediate proximity to the inner jacket surface 252.

In a preferred embodiment of the invention, the forming vessel 202 is removably positioned within the inner passage formed by the side wall 250 of the thermal jacket 202. In this manner, the forming vessel 202 can be removed from the thermal jacket 204 for periodic maintenance. As should be appreciated, vessels or crucibles that are used in the formation and processing of metals tend to deteriorate and wear out over time. This is particularly the case when dealing with relatively corrosive metals such as aluminum or aluminum alloys. As a result, periodic removal and replacement of the vessel or crucible is typically required. Additionally, solidified residual metal tends to build up on the interior and exterior surfaces of the vessel during processing. Accordingly, the forming vessel must usually be cleaned at periodic intervals to avoid contamination of the processed metal. Since the forming vessel 202 is removably positioned within the thermal jacket 204, the forming vessel 202 can be easily and conveniently separated from the thermal jacket 204 to clean and/or replace the forming vessel 202. In this manner, handling of the thermal jacket 204 during maintenance of the forming vessel 202 may be avoided. Additionally, in the event the forming vessel 202 requires replacement, the thermal jacket 204 can be reused with a new forming vessel 202, thereby eliminating the need to replace the thermal jacket 204.

In one embodiment of the invention, the outer surface 222 of the forming vessel 202 is tapered from the open end 214 to the closed end 215, thereby defining a first diameter $D_1$ adjacent the open end 214 which gradually transitions into a larger second diameter $D_2$ adjacent the closed end 215. The inner surface 252 of the thermal jacket 204 also defines an outward taper that closely corresponds to the outward taper of the forming vessel 202. In this manner, when the forming vessel 202 is positioned within the inner passage of the thermal jacket 204, the outer vessel surface 222 will be disposed in immediate proximity to, and preferably in abutment against, the inner jacket surface 252 to effectuate heat transfer therebetween. The complementary tapers of the outer vessel surface 222 and the inner jacket surface 252 facilitate insertion of the forming vessel 202 into the thermal jacket 204 and also ensure a tight fit between the surfaces 222, 252 to provide optimum heat transfer capabilities. In the illustrated embodiment, the forming vessel 202 is inserted within the inner passage of the thermal jacket 204 from the wider bottom end 260 toward the narrower top end 258. However, it should be understood that in an alternative embodiment of the invention, the outer vessel surface 222 may be inwardly tapered from the open end 214 toward the closed end 215, with the inner surface 252 of the thermal jacket 204 defining a corresponding inward taper. In this alternative embodiment, the forming vessel 202 would be inserted into the inner passage of the thermal jacket 204 from the wider top end 258 toward the narrower bottom end 260.

Figure 20:
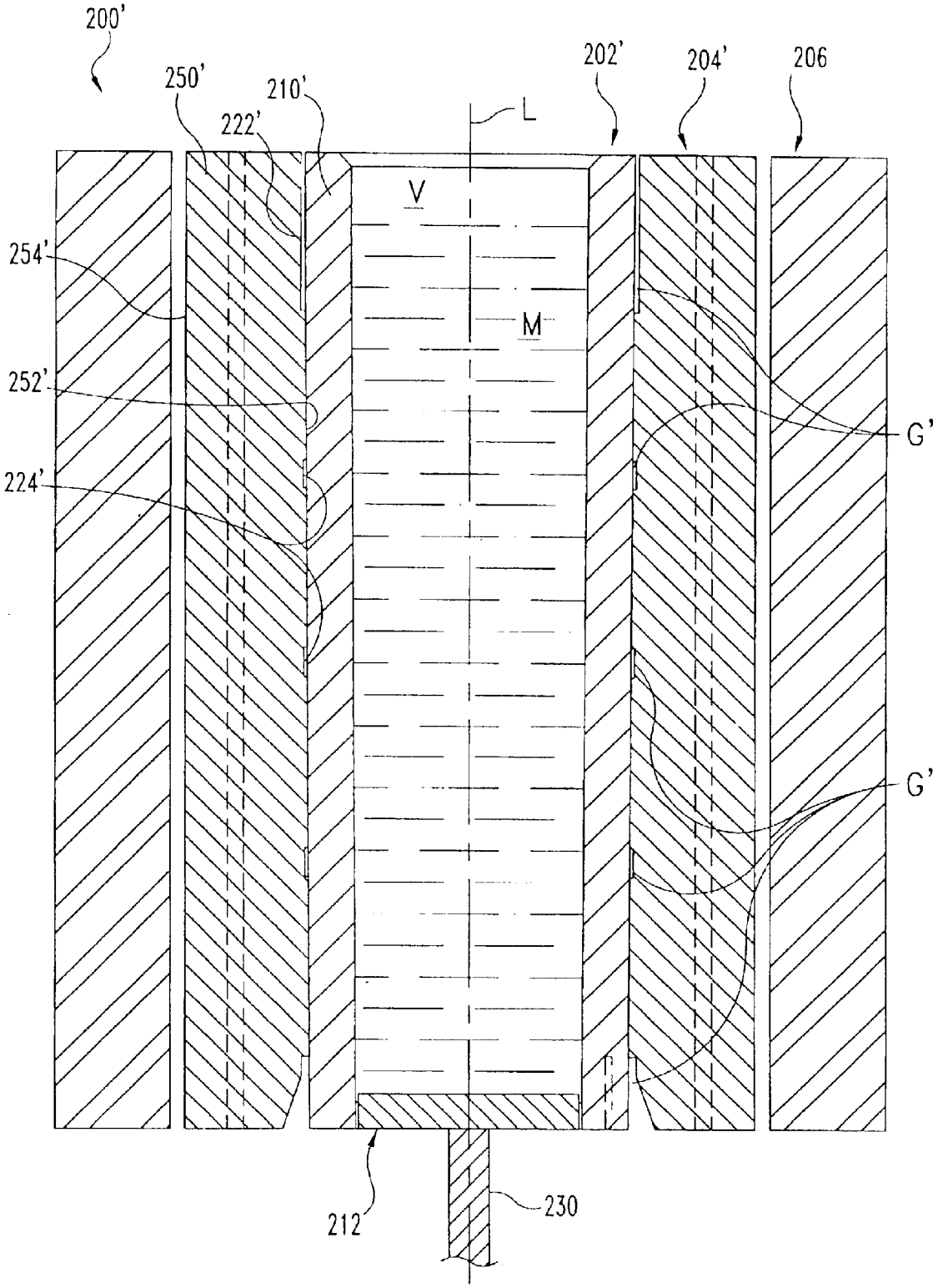
FIG. 20 is a side cross sectional view of an apparatus according to an alternative form of the present invention for use in producing a metallic slurry material for in semisolid forming of shaped parts.

Referring to FIG. 20, shown therein is an apparatus 200' according to another form of the present invention for producing a metallic slurry material for use in semi-solid forming of shaped parts. Similar to the apparatus 200 illustrated and described above, the apparatus 200' extends along a longitudinal axis L and is generally comprised of a forming vessel or crucible 202' defining an inner volume V for containing a select amount of metallic melt M, a thermal jacket 204' for controlling the temperature and cooling rate of the metallic melt M contained within the forming vessel 202', and an electromagnetic stator 206 disposed about the thermal jacket 204' and adapted to impart an electromagnetic stirring force to the metallic melt M contained within the forming vessel 202'.

In many respects, the forming vessel 202' is configured similar to the forming vessel 202. However, unlike the forming vessel 202 which includes a side wall 220 having an outer surface 220 defining a number of grooves 224 therein, the side wall 210' of the forming vessel 202' defines a substantially smooth outwardly facing surface 222'. Likewise, the thermal jacket 204' is configured similar to the thermal jacket 204. The thermal jacket 204' includes a side wall 250' having an inwardly facing surface 252' and an outwardly facing surface 254'. However, the side wall 250' defines a number of grooves 224' therein extending outwardly from the inner surface 252' toward the outer surface 254'. The grooves 224' may take on configurations, orientations and sizes similar to those discussed above with regard to the grooves 224 defined in the side wall 210 of the forming vessel 202.

As should be appreciated, the portions of the forming vessel 202' defined by the grooves 224' are spaced from the outer vessel surface 222' to define a series of gaps G' between the forming vessel 202' and the thermal jacket 204'. As should also be appreciated, the grooves 224' function in a manner similar to that of the grooves 224. More specifically, the grooves 224' serve to limit or regulate the rate of heat transfer between the forming vessel 202' and the thermal jacket 204' in the areas adjacent the gaps G' formed by the grooves 224'. By limiting the rate of heat transfer in the areas adjacent the grooves 224', the amount of heat extracted from or added to the metallic melt M can be more accurately controlled to provide the metallic melt M with a predetermined viscosity and microstructure that is substantially uniform and homogenous along the axial length of the forming vessel 202. It should also be understood that the gaps G' may be filled with an insulating or conductive material to vary the heat transfer characteristics adjacent the grooves 224'.

Having described the various features associated with the apparatus 200, reference will now be made to the production of a metallic slurry material for use in semi-solid forming of shaped parts. A select amount of liquid metal, previously referred to as metallic melt M, is initially introduced into the inner volume V of the forming vessel 202 through the open end 214. To avoid the formation of a solidified skin, possibly resulting from contact of the liquid metal with the interior surfaces of vessel 202, the side wall 210 and the bottom wall 212 of the forming vessel 202 are preferably pre-heated prior to the introduction of molten metal M into the inner volume V. Such warming may be effected by way of the thermal jacket 204 and/or via a heating means incorporated into the design of the forming vessel 202. Following the introduction of the molten melt M into the vessel 202, a cap or lid (not shown) may be positioned over the open end 214 of forming vessel 202 to prevent the escape of molten metal and to reduce the amount of uncontrolled heat loss to the surrounding environment. An electromagnetic field is then introduced via actuation of the stator 206 to impart a stirring force onto the metallic melt M.

Partial solidification of the metallic melt M contained within the forming vessel 202 is effectuated by cooling the metallic melt at a controlled rate via the heat transfer capabilities of the thermal jacket 204, thereby resulting in the production of a metallic slurry material in the form of a semi-solid slurry billet B. More specifically, heat is transferred from the metallic melt M to the forming vessel 202, and in turn from the forming vessel 202 to the thermal jacket 204, to partially solidify the metallic melt M into a semi-solid slurry billet B. In one embodiment of the invention, the rate of heat transfer between the thermal jacket 204 and the forming vessel 202 is regulated to control the cooling rate of the metallic melt within a range between about 1 degree Celsius per second and about 10 degrees Celsius per second. In a more specific embodiment, the cooling rate of the metallic melt is controlled within a range between about 0.5 degrees Celsius per second to about 5 degrees Celsius per second. However, it should be understood that other cooling rates of the metallic melt are also contemplated as falling within the scope of the present invention.

In a preferred embodiment of the invention, the microstructure of the semi-solid slurry billet B comprises rounded solid particles dispersed in a liquid metal matrix. In one embodiment of the invention, the semi-solid billet B is thixotropic. As discussed above, limiting the rate of heat transfer in the areas adjacent the grooves 224*a*–224*e* formed along the vessel side wall 210 correspondingly controls the amount of heat extracted from the metallic melt M adjacent the grooves 224*a*–224*e*. Limiting the rate of heat transfer adjacent the grooves 224*a*–224*e* in turn results in the formation of a semi-solid slurry billet B having a substantially uniform and homogenous viscosity and microstructure along the axial length of the forming vessel 202.

Figure 19:
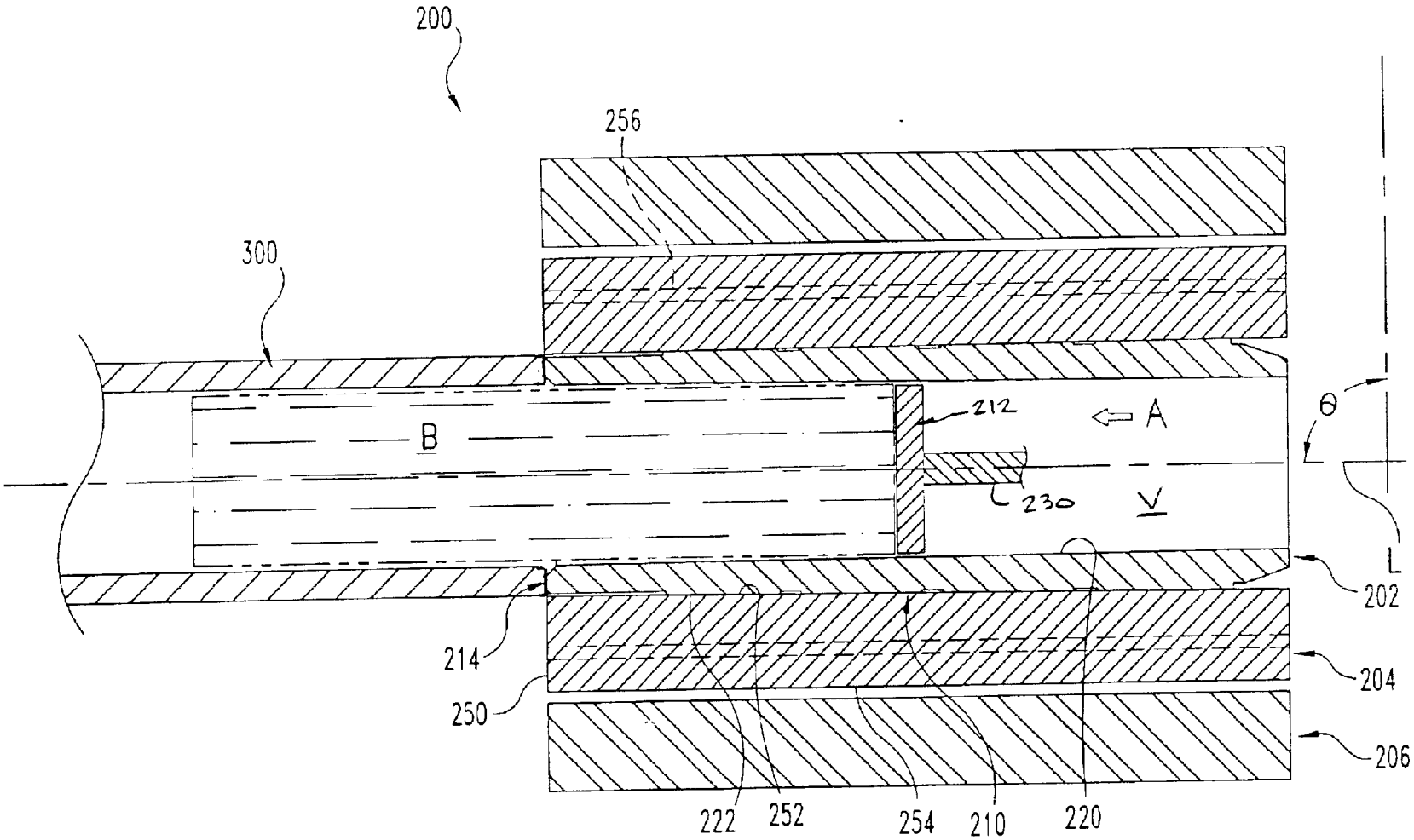
FIG. 19 is a side cross sectional view of the apparatus illustrated in FIG. 15, as shown in a substantially horizontal orientation as the metallic slurry material is discharged from the forming vessel.

Referring to FIG. 19, means are employed to discharge the semi-solid slurry billet B from the forming vessel 202 for subsequent formation into a shaped part (not shown). In the illustrated embodiment, the apparatus 200 is arranged at a discharge angle θ to facilitate removal of the semi-solid slurry billet B from the inner volume V of the forming vessel 202. In one embodiment of the invention, the apparatus 200 is initially oriented in a substantially vertical orientation during processing of the metallic melt M (FIG. 18), and is subsequently tilted to a substantially horizontal orientation (FIG. 19), thereby defining a discharge angle θ of about 90 degrees. It should be understood, however, that other discharge angles θ are also contemplated as falling within the scope of the present invention, including discharge angles θ of less than or greater than 90 degrees. Tilting of the forming vessel 202 may be accomplished by a tilt table arrangement, a robotic arm, or any other means for tilting as would be apparent to those of skill in the art. The bottom wall 212 is then axially displaced along the inner volume V of the forming vessel in the direction of arrow A via actuation of the piston 230 to discharge the slurry billet B from the forming vessel 202.

In one embodiment of the invention, the semi-solid slurry billet B is discharged from the forming vessel 202 directly into a shot sleeve 300 for subsequent formation into a shaped part. In a preferred embodiment of the invention, the semi-solid slurry billet B is formed into a shaped part substantially immediately after being discharged from the forming vessel 202. Substantial immediate formation of the semi-solid slurry billet B into a shaped part prevents further appreciable solidification of the semi-solid slurry billet B which might otherwise result in a corresponding change in microstructure of the semi-solid slurry material. As would be appreciated by those of skill in the art, the shot sleeve 300 is equipped with a ram or a similar mechanism (not shown) configured to discharge the slurry billet B into a die mold (not shown) for subsequent formation into a shaped part. The shot sleeve 300 may also be equipped with means for regulating the temperature and cooling rate of the semi-solid slurry billet B to provide further control over the microstructure of the slurry material prior to being formed into a shaped part. In another embodiment of the invention, the slurry billet B may be discharged from the forming vessel 202 directly into a die mold (not shown) for immediate formation into a shaped part.

Although the illustrated embodiment of the invention utilizes a movable bottom wall to discharge the semi-solid slurry billet B from the forming vessel 202, it should be understood that other methods for discharging the slurry billet B from the forming vessel 202 are also contemplated. For example, as disclosed in U.S. Pat. No. 6,399,017 to Norville et al., the slurry billet B may be discharged from the forming vessel 202 by simply tilting the vessel 202 at a discharge angle θ of greater than 90 degrees to allow the slurry billet B to slide from the vessel 202 via gravity. As also disclosed in U.S. Pat. No. 6,399,017, other means may be used for discharging the slurry billet B from the forming vessel 202, such as, for example, through the use of an induction coil positioned adjacent the forming vessel 202.

While the invention has been illustrated and described in detail in the drawings and foregoing description, the same is to be considered as illustrative and not restrictive in character, it being understood that the preferred embodiment has been shown and described and that all changes and modifications that come within the spirit of the invention are desired to be protected.

What is claimed is:

1. A metallic slurry material producing apparatus for use in semi-solid forming, comprising:

a vessel defining an inner volume for containing the metallic slurry material and having an outer surface, and a thermal jacket having an inner surface disposed in thermal communication with said outer surface of said vessel to effectuate heat transfer therebetween, and wherein at least one of said vessel and said thermal jacket defines at least one groove to limit said heat transfer adjacent said at least one groove.

2. The apparatus of claim 1, wherein said inner volume of said vessel extends along a longitudinal axis and wherein said at least one groove comprises a plurality of axially-offset grooves.

3. The apparatus of claim 2, wherein said plurality of grooves extend peripherally about said at least one of said vessel and said thermal jacket.

4. The apparatus of claim 3, wherein said plurality of grooves extend peripherally about said exterior surface of said vessel.

5. The apparatus of claim 2, wherein adjacent ones of said plurality of grooves are axially offset by a non-uniform offset distance.

6. The apparatus of claim 5, wherein said vessel has an open end and an opposite closed end, said non-uniform offset distance gradually increasing toward said closed end.

7. The apparatus of claim 2, wherein said vessel has an open end and an opposite closed end, one of said plurality of grooves being disposed adjacent said open end and having an axial width greater than an axial width of another of said plurality of grooves.

8. The apparatus of claim 1, wherein said at least one groove has a groove width and a groove depth, said groove width being greater than said groove depth.

9. The apparatus of claim 8, wherein said groove width is at least twice said groove depth.

10. The apparatus of claim 1, wherein first portions of said outer surface of said vessel are disposed in immediate proximity to said inner surface of said thermal jacket to effectuate conductive heat transfer; and wherein second portions of said outer surface of said vessel are spaced from said inner surface of said thermal jacket adjacent said at least one groove to effectuate convective heat transfer.

11. The apparatus of claim 10, wherein said first and second portions of said outer surface extend peripherally about said vessel.

12. The apparatus of claim 1, further comprising a stator disposed about at least a portion of said thermal jacket, said stator adapted to impart an electromagnetic stirring force to said metallic slurry material contained within said vessel.

13. The apparatus of claim 1, wherein said thermal jacket includes a plurality of axial passageways adapted to carry a heat transfer media, said heat transfer media flowing through said plurality of passageways to effectuate said heat transfer between said thermal jacket and said vessel.

14. The apparatus of claim 1, wherein said inner volume of said vessel defines a draft angle to facilitate discharge of the metallic slurry material from said vessel.

15. The apparatus of claim 1, further comprising means for discharging the metallic slurry material from said vessel.

16. The apparatus of claim 1, wherein said vessel includes a movable end wall axially displaceable along said inner volume to discharge the metallic slurry material from said vessel.

17. The apparatus of claim 16, wherein the metallic slurry material is discharged from said vessel into a shot sleeve for substantially immediate formation into a shaped part.

18. The apparatus of claim 17, wherein the metallic slurry material is discharged from said vessel when said vessel is in a substantially horizontal orientation.

19. The apparatus of claim 16, wherein the metallic slurry material is discharged from said vessel directly into a die mold for immediate formation into a shaped part.

20. The apparatus of claim 1, wherein said thermal jacket defines an inner passage, said vessel being removably positioned within said inner passage of said thermal jacket.

21. The apparatus of claim 20, wherein said outer surface of said vessel is tapered, said inner surface of said thermal jacket being correspondingly tapered such that said outer surface of said vessel is disposed in immediate proximity to said inner surface of said thermal jacket when said vessel is removably positioned within said inner passage of said thermal jacket.

22. The apparatus of claim 1, wherein said thermal jacket is adapted to control the cooling rate of the metallic slurry material contained within said vessel to form a semi-solid material having a microstructure comprising rounded solid particles dispersed in a liquid metal matrix.

23. The apparatus of claim 22, wherein said cooling rate is between about 1 degree Celsius per second to about 10 degrees Celsius per second.

24. The apparatus of claim 23, wherein said cooling rate is between about 0.5 degrees Celsius per second to about 5 degrees Celsius per second.

25. A metallic slurry material producing apparatus for use in semi-solid forming, comprising:

a vessel defining an inner volume for containing the metallic slurry material and having an outer surface, and a thermal jacket having an inner surface disposed in thermal communication with said outer surface of said vessel, and wherein first portions of said inner of said thermal jacket and outer surfaces of said vessel are disposed in immediate proximity to one another to facilitate conductive heat transfer, and wherein second portions of said inner of said thermal jacket and outer surfaces of said vessel are spaced apart to form at least one air gap to facilitate convective heat transfer.

26. The apparatus of claim 25, wherein said air gap is formed by a groove defined by one of said inner and outer surfaces.

27. The apparatus of claim 26, wherein said groove extends peripherally about said outer surface of said vessel.

28. The apparatus of claim 25, wherein said inner volume of said vessel extends along a longitudinal axis; and wherein second portions of said inner and outer surfaces are spaced apart to form a plurality of axially-offset air gaps.

29. The apparatus of claim 28, wherein said plurality of air gaps extend peripherally about said outer surface of said vessel.

30. A metallic slurry material producing apparatus for use in semi-solid forming, comprising:

a vessel defining an inner volume for containing the metallic slurry material, and a thermal jacket defining an inner passage sized and shaped to receive at least a portion of said vessel therein, at least one of said vessel and said thermal jacket defining at least one groove; and wherein said at least a portion of said vessel is removably disposed within said inner passage of said thermal jacket to position said vessel in thermal communication with said thermal jacket to effectuate heat transfer therebetween, said heat transfer being limited adjacent said at least one groove.

31. The apparatus of claim 30, wherein said inner volume of said vessel extends along a longitudinal axis and wherein said at least one groove comprises a plurality of axially-offset grooves.

32. The apparatus of claim 31, wherein said plurality of axially-offset grooves extend peripherally about said at least one of said vessel and said thermal jacket.

33. The apparatus of claim 32, wherein said plurality of grooves extend peripherally about an exterior surface of said vessel.

34. The apparatus of claim 30, wherein first portions of said vessel are disposed in immediate proximity to said thermal jacket to effectuate conductive heat transfer; and wherein second portions of said vessel are spaced from said thermal jacket adjacent said at least one groove to effectuate convective heat transfer.

35. The apparatus of claim 34, wherein said first and second portions of said outer surface extend peripherally about said vessel.

36. The apparatus of claim 30, wherein said vessel includes a tapered outer surface, said thermal jacket including a tapered inner surface corresponding to said tapered outer surface of said vessel such that said outer surface of said vessel is disposed in immediate proximity to said inner surface of said thermal jacket when said vessel is removably positioned within said inner passage of said thermal jacket.

37. The apparatus of claim 30, further comprising a stator disposed about at least a portion of said thermal jacket, said stator adapted to impart an electromagnetic stirring force to said metallic slurry material contained within said vessel.

38. The apparatus of claim 30, further comprising means for discharging the metallic slurry material from said vessel for substantially immediate formation into a shaped part.

39. The apparatus of claim 30, wherein said vessel includes a movable end wall axially displaceable along said inner volume to discharge the metallic slurry material from said vessel for substantially immediate formation into a shaped part.

40. A metallic slurry material producing apparatus for use in semi-solid forming, comprising:

a temperature-controlled vessel including an inner layer and an outer layer, said inner layer defining an inner volume for containing the metallic slurry material, said outer layer disposed about at least a portion of said inner layer, said inner layer having an outer surface disposed in thermal communication with an inner surface of said outer layer to effectuate heat transfer therebetween; and wherein at least one of said inner and outer surfaces defines at least one groove to limit said heat transfer adjacent said at least one groove.

41. The apparatus of claim 40 wherein said inner volume of said vessel extends along a longitudinal axis and wherein said at least one groove comprises a plurality of axially-offset grooves.

42. The apparatus of claim 41, wherein said plurality of grooves extend peripherally about said outer surface of said inner layer of said vessel.

43. The apparatus of claim 40, wherein first portions of said outer surface of said inner layer are disposed in immediate proximity to said inner surface of said outer layer to effectuate conductive heat transfer; and wherein second portions of said outer surface of said inner layer are spaced from said inner surface of said outer layer adjacent said at least one groove to effectuate convective heat transfer.

* * * * *